US009132052B2

(12) United States Patent
Fowler et al.

(10) Patent No.: US 9,132,052 B2
(45) Date of Patent: Sep. 15, 2015

(54) APPARATUS AND METHOD FOR POSITIONING A SEATED PATIENT

(75) Inventors: Paul M. Fowler, Rockford, IL (US); Craig S. Golden, Arlington Heights, IL (US)

(73) Assignee: Sage Products, LLC, Cary, IL (US)

( * ) Notice: Subject to any disclaimer, the term of this patent is extended or adjusted under 35 U.S.C. 154(b) by 492 days.

(21) Appl. No.: 13/445,488

(22) Filed: Apr. 12, 2012

(65) Prior Publication Data

US 2013/0270881 A1 Oct. 17, 2013

(51) Int. Cl.
*A61G 7/10* (2006.01)
*A61G 5/10* (2006.01)

(52) U.S. Cl.
CPC ..... *A61G 7/1023* (2013.01); *A61G 7/1026* (2013.01); *A61G 7/1032* (2013.01); *A61G 2005/1045* (2013.01); *A61G 2200/34* (2013.01)

(58) Field of Classification Search
CPC . A61G 7/1023; A61G 7/1026; A61G 7/1032; A61G 2005/1045; A61G 2200/34
USPC ..... 5/81.1 R, 81.1 HS; 297/344.16, 344.12, 297/452, 21
See application file for complete search history.

(56) References Cited

U.S. PATENT DOCUMENTS

| | | | |
|---|---|---|---|
| 1,334,901 | A | 3/1920 | Higdon |
| 3,333,286 | A | 8/1967 | Biolik |
| 3,452,372 | A | 7/1969 | Emery |
| 3,965,503 | A | 6/1976 | Gridel |
| 4,048,681 | A | 9/1977 | Baulch et al. |
| 4,214,326 | A | 7/1980 | Spann |
| 4,233,700 | A | 11/1980 | Spann |
| 4,662,016 | A | 5/1987 | Seeman |
| 4,675,925 | A | 6/1987 | Littleton |
| 4,802,249 | A | 2/1989 | Bills |
| 4,858,625 | A | 8/1989 | Cramer |

(Continued)

FOREIGN PATENT DOCUMENTS

| | | |
|---|---|---|
| DE | 102010007457 A1 | 8/2011 |
| FR | 2923367 | 5/2009 |

(Continued)

OTHER PUBLICATIONS

Nov. 28, 2014—(EP) Search Report—App 14159820.1.

(Continued)

*Primary Examiner* — Peter M Cuomo
*Assistant Examiner* — Brittany Wilson
(74) *Attorney, Agent, or Firm* — Banner & Witcoff, Ltd.

(57) ABSTRACT

An apparatus is configured for use with a chair having a supporting surface, and includes a cushioning member adapted to be placed above the supporting surface, a bottom sheet connected to the cushioning member and having an engagement surface opposite the cushioning member, a top sheet having a bottom surface positioned in confronting relation to the engagement surface and a top surface opposite the bottom surface, and a selective gliding assembly positioned between the top and bottom sheets. The top sheet has at least one end connected to the bottom sheet, and the top sheet further has a slip resistant material positioned on the top surface. The selective gliding assembly includes engagement members positioned on the engagement surface and on the bottom surface of the top sheet, and the engagement members engage each other to resist forward sliding of the top sheet and to permit rearward sliding of the top sheet.

34 Claims, 21 Drawing Sheets

(56) References Cited

U.S. PATENT DOCUMENTS

| | | | |
|---|---|---|---|
| 5,138,731 | A | 8/1992 | Harcrow, Jr. |
| 5,182,828 | A | 2/1993 | Alivizatos |
| 5,193,238 | A | 3/1993 | Clute |
| 5,329,655 | A | 7/1994 | Garner |
| 5,448,790 | A | 9/1995 | Saro et al. |
| RE35,468 | E | 3/1997 | Newman |
| 6,154,900 | A | 12/2000 | Shaw |
| 6,560,793 | B2 | 5/2003 | Walker |
| 6,658,676 | B1 | 12/2003 | Persson et al. |
| 6,804,845 | B2 | 10/2004 | Stewart, III et al. |
| 6,874,176 | B2 | 4/2005 | Berge |
| 7,240,384 | B2 | 7/2007 | DuDonis |
| 7,506,387 | B1 | 3/2009 | Scordato et al. |
| 7,571,498 | B2 | 8/2009 | Jewell et al. |
| 8,161,583 | B1 | 4/2012 | Palen |
| 8,789,533 | B2 | 7/2014 | Steffens et al. |
| 2001/0040402 | A1 | 11/2001 | Odderson |
| 2002/0029417 | A1 | 3/2002 | Walker |
| 2005/0005358 | A1 | 1/2005 | DuDonis |
| 2005/0055768 | A1 | 3/2005 | Assink |
| 2005/0229314 | A1 | 10/2005 | Chisari |
| 2006/0213010 | A1 | 9/2006 | Davis |
| 2010/0257703 | A1 | 10/2010 | Vass |
| 2011/0304186 | A1 * | 12/2011 | Andrews ..... 5/81.1 HS |
| 2012/0186587 | A1 | 7/2012 | Steffens et al. |
| 2013/0205495 | A1 | 8/2013 | Ponsi et al. |
| 2014/0304918 | A1 | 10/2014 | Steffens et al. |

FOREIGN PATENT DOCUMENTS

| | | | |
|---|---|---|---|
| GB | 2300845 | A * | 11/1996 |
| JP | 10117907 | | 5/1998 |
| WO | 8810082 | A1 | 12/1988 |
| WO | 9627357 | | 9/1996 |
| WO | 02065877 | A1 | 8/2002 |
| WO | 2004050002 | | 6/2004 |
| WO | 2005107673 | A1 | 11/2005 |
| WO | 2012170934 | A2 | 12/2012 |

OTHER PUBLICATIONS

Dec. 4, 2012—(WO) International Search Report and Written Opinion—App PCT/US2012/041729.
May 15, 2014—(WO) International Search Report and Written Opinion—App PCT/US12/22572.
IPRP dated Dec. 10, 2013 from PCT/US2012/041729.
Jul. 12, 2013—(WO) International Search Report and Written Opinion—App PCT/US20131036448.
Prism Medical Company, 5300 Ergoglide Instructions, 2009, 2 pp. Maryland Heights, MO.
Waverley Glen, One-Way Glide—The Grimstead Range of Transfer and Repositioning Aids, 2 pp., Ontario Canada, downloaded Jun. 11, 2012.
May 15, 2015—(WO) International Search Report and Written Opinion—App PCT/US2014/067672.
Texbook of Palliative Nursing, Nov. 10, 2005, Oxford University Press, XP002740850, 1 page.
Jun. 25, 2015—(EP) Extended Search Report—App 12739957.

* cited by examiner

APPARATUS AND METHOD FOR POSITIONING A SEATED PATIENT

TECHNICAL FIELD

The present invention generally relates to an apparatus and method for positioning a person in a seated position, and, more particularly, to an apparatus configured to facilitate moving the person rearwardly in a chair and to resist the person sliding forwardly and/or downwardly in the chair, as well as methods including one or more of such apparatuses.

BACKGROUND

Nurses and other caregivers at hospitals, assisted living facilities, and other locations often care for patients that have limited or no mobility, many of whom are critically ill or injured. The caregivers of such patients can often encounter difficulties in positioning the patients in seated positions and/or maintaining the patients in seated positions, due to this decreased mobility. This can make the use of chairs (including traditional chairs, wheelchairs, and other seating apparatuses) difficult on both the patient and the caregiver. Patients with severely decreased mobility may need to be pushed or pulled backward in the chair to be seated in the proper position, which can cause strain on the caregiver. Additionally, patients with decreased mobility may tend to slide downward and forward in a chair after proper positioning, which can even pose challenges with patients having sufficient mobility to position themselves in the chair. Such sliding may also result in falls from excessive forward sliding and/or from patients trying to reposition themselves after sliding. Further, pressure ulcers can pose problems for patients spending significant time in seated and/or lying positions. Existing apparatuses and methods often do not provide adequate assistance in positioning a patient in a seated position and/or maintaining the patient in the seated position. Existing apparatuses and methods also often may not provide adequate protection against the risk of falls and pressure ulcers when decreased mobility patients are placed in chairs.

The present invention seeks to overcome certain of these limitations and other drawbacks of existing apparatuses, systems, and methods, and to provide new features not heretofore available.

BRIEF SUMMARY

The present invention relates generally to an apparatus or device for use with a chair having a supporting surface. The apparatus includes a cushioning member adapted to be placed above the supporting surface of the chair, a bottom sheet connected to the cushioning member and having an engagement surface opposite the cushioning member, a top sheet having a bottom surface positioned in confronting relation to the engagement surface of the bottom sheet and a top surface opposite the bottom surface, and a selective gliding assembly positioned between the top sheet and the bottom sheet. The top sheet may have at least one end connected to the bottom sheet, and the top sheet further has a slip resistant material positioned on the top surface. The selective gliding assembly includes a first engagement member positioned on the engagement surface of the bottom sheet and a second engagement member positioned on the bottom surface of the top sheet, where the first engagement member and the second engagement member engage each other to resist sliding of the top sheet in a forward direction relative to the bottom sheet and to permit sliding of the top sheet in a rearward direction relative to the bottom sheet.

According to one aspect, the top sheet has a front edge connected to the bottom sheet, a rear edge connected to the bottom sheet, and side edges that are free with respect to the bottom sheet.

According to another aspect, the cushioning member contains a bladder that is adapted to be filled with fluid to provide cushioning. The bladder may include a first chamber and a second chamber each configured to be filled with fluid, where the first chamber and second chamber are sealed apart from each other. Additionally, the cushioning member may further include a stiffening member positioned near a front end of the apparatus, the stiffening member providing added rigidity to the cushioning member and the bottom sheet.

According to a further aspect, the first engagement member is formed at least partially of a brushed fiber material and the second engagement member is formed at least partially of a stitched material with a directional stitching pattern extending in the width direction. The stitched material may have a herringbone stitching pattern. Additionally, the first engagement member and the second engagement member may engage each other to resist sliding of the top sheet in the forward direction relative to the bottom sheet and to permit sliding of the top sheet in the rearward direction and in both lateral directions relative to the bottom sheet. Further, the first engagement member may include two strips of the brushed fiber material extending across the engagement surface in the forward direction and spaced laterally from each other, and the second engagement member may include a pad of the stitched material, the pad having a width that completely overlaps both of the two strips of the first engagement member.

According to yet another aspect, the apparatus further includes two straps attached to the top sheet and extending from opposed lateral edges of the top sheet, the straps configured to be grasped by a user to move the top sheet in the rearward direction relative to the bottom sheet.

According to a still further aspect, the apparatus further includes a second cushioning member connected to a rear end of the apparatus and adapted to extend upward from the rear end of the apparatus.

According to an additional aspect, the apparatus further includes a movement limiting mechanism that releasably connects the top sheet to the bottom sheet and temporarily limits movement of the top sheet with respect to the bottom sheet until the movement limiting mechanism is released. The movement limiting mechanism may include one or more hook and loop connections or other releasable, and optionally reconnectable, connection(s) in various configurations.

Additional aspects of the invention relate to an apparatus for use with a chair having a supporting surface. The apparatus includes a first member adapted to be placed above the supporting surface of the chair, with the first member having a cushioning member and an engagement surface on a top of the cushioning member, a second member connected to the first member and having a bottom surface positioned in confronting relation to the engagement surface of the first member and a top surface opposite the bottom surface, and first and second engagement members, with one engagement member positioned on the engagement surface of the first member and the other engagement member positioned on the bottom surface of the second member. The second member is connected to the first member such that at least a portion of the second member is slidable with respect to the first member. The first engagement member includes a brushed fiber material, and the second engagement member includes a stitched material with a directional stitching pattern extending in the width direction. The first engagement member and the second engagement member engage each other to resist sliding of the second member in a forward direction relative to the first member and to permit sliding of the second member in a rearward direction and in both lateral directions relative to the first member. The stitched material may have a herringbone stitching pattern in one embodiment.

According to one aspect, the second member has a front edge connected to the first member, a rear edge connected to the first member, and side edges that are free with respect to the first member.

According to another aspect, the cushioning member includes a bladder that is adapted to be filled with fluid to provide cushioning. The bladder may include a first chamber and a second chamber each configured to be filled with fluid, where the first chamber and second chamber are sealed apart from each other. Additionally, the cushioning member may further include a stiffening member positioned near a front end of the apparatus, the stiffening member providing added rigidity to the cushioning member and the first member.

According to a further aspect, the first engagement member is connected to the engagement surface of the first member, and the second engagement member is connected to the bottom surface of the second member. In this configuration, the first engagement member may include two strips of the brushed fiber material extending across the engagement surface in the forward direction and spaced laterally from each other, and the second engagement member may include a pad of the stitched material, the pad having a width that completely overlaps both of the two strips of the first engagement member.

According to yet another aspect, the apparatus further includes two straps attached to the second member and extending from opposed lateral edges of the second member, the straps configured to be grasped by a user to move the second member in the rearward direction relative to the first member.

Further aspects of the invention relate to an apparatus for use with a chair having a supporting surface. The apparatus includes a cushioning member adapted to be placed above the supporting surface of the chair, a bottom sheet comprising a nylon material connected to the cushioning member and having an engagement surface opposite the cushioning member, a top sheet comprising the nylon material and having a bottom surface positioned in confronting relation to the engagement surface of the bottom sheet and a top surface opposite the bottom surface, a first engagement member positioned on the engagement surface of the bottom sheet, and a second engagement member positioned on the bottom surface of the top sheet. The cushioning member includes a bladder that is adapted to be filled with fluid to provide cushioning. The top sheet has a front edge connected to the bottom sheet, and further has a slip resistant material positioned on the top surface. The first engagement member includes a strip of a brushed fiber material extending across the engagement surface in a forward direction. The second engagement member includes a pad of a stitched material having a herringbone stitching pattern extending in the width direction, the pad having a width that completely overlaps the first engagement member. The first engagement member and the second engagement member engage each other to resist sliding of the top sheet in a forward direction relative to the bottom sheet and to permit sliding of the top sheet in a rearward direction and in both lateral directions relative to the bottom sheet.

According to one aspect, the first engagement member comprises two strips of the brushed fiber material extending across the engagement surface in the forward direction and spaced laterally from each other, and wherein the width of the pad completely overlaps both of the two strips of the first engagement member.

Still further aspects of the invention relate to a method for use with a chair provided with a supporting surface and a back positioned at a rear of the supporting surface. The method includes placing an apparatus generally as described above on the chair, positioning a person in a seated position on the chair, such that the person rests on and/or above the top surface of the top sheet and confronts and/or engages at least a portion of the slip resistant material, and sliding the top sheet in the rearward direction toward the back of the chair, such that the person is pulled in the rearward direction by the sliding of the top sheet.

According to one aspect, the apparatus further includes two straps attached to the top sheet and extending from opposed lateral edges of the top sheet, and sliding the top sheet is accomplished by grasping and pulling the straps in the rearward direction.

According to another aspect, the top sheet has a front edge connected to the bottom sheet, a rear edge connected to the bottom sheet, and side edges that are free with respect to the bottom sheet. In this configuration, the person is positioned in the seated position when the top sheet is in a forward position and slack material between the top and bottom sheets is positioned at a front of the supporting surface. After sliding the top sheet in the rearward direction, the top sheet is in a rearward position, such that at least some slack material between the top and bottom sheets is positioned at the rear of the supporting surface.

Other features and advantages of the invention will be apparent from the following specification taken in conjunction with the following drawings.

DETAILED DESCRIPTION

Figure 1:
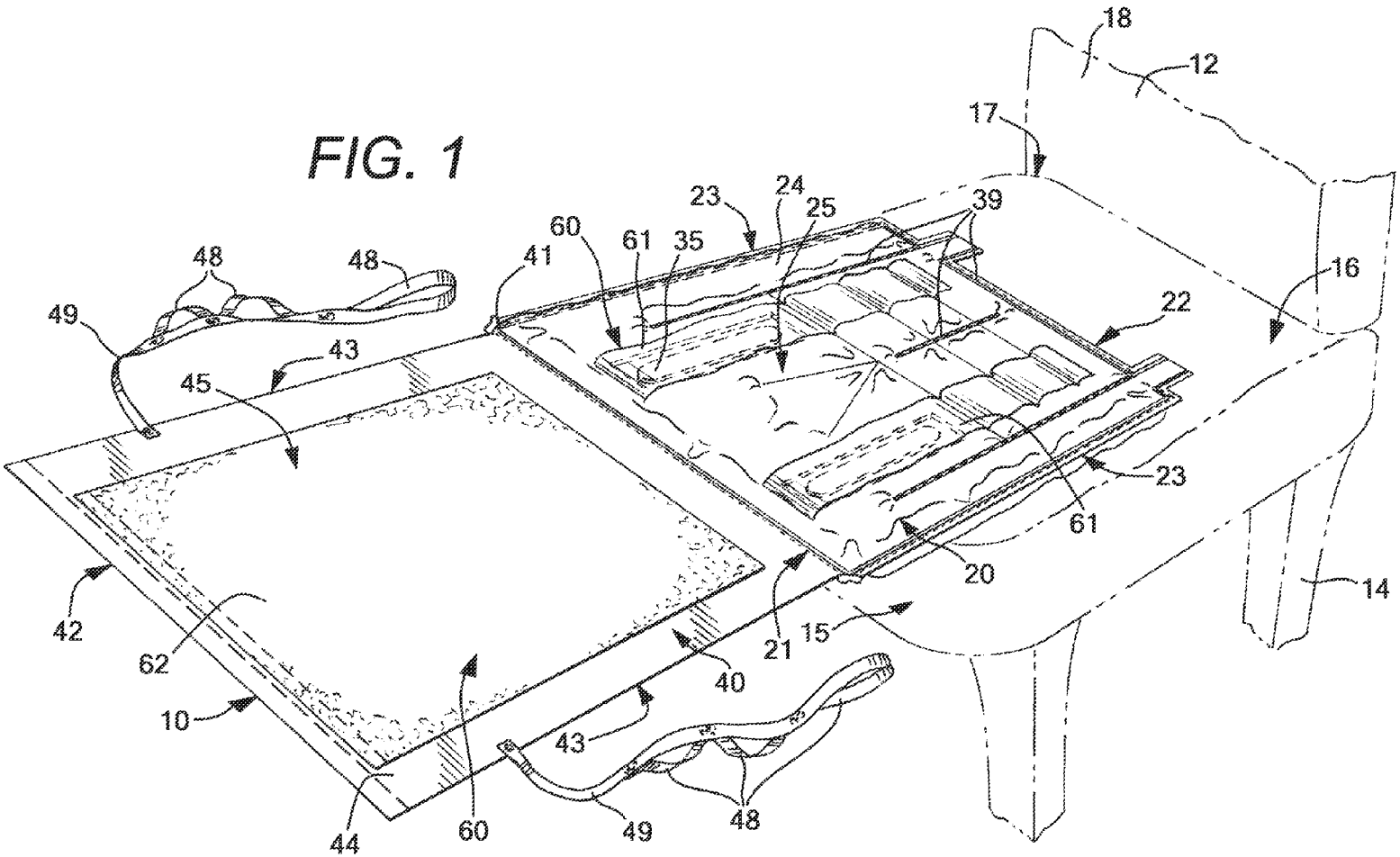
FIG. 1 is a top perspective view of an apparatus for positioning a person in a seated position, in an unfolded and open configuration, shown with a chair schematically illustrated in broken lines.

While this invention is susceptible of embodiment in many different forms, there are shown in the drawings, and will herein be described in detail, preferred embodiments of the invention with the understanding that the present disclosure is to be considered as an exemplification of the principles of the invention and is not intended to limit the broad aspects of the invention to the embodiments illustrated and described.

In general, the invention relates to one or more apparatuses or devices for positioning a person in a seated position, such as in a chair, including a cushioning member adapted to be placed above the supporting surface of the chair, a bottom sheet connected to the cushioning member and having an engagement surface opposite the cushioning member, a top sheet having a bottom surface positioned in confronting relation to the engagement surface of the bottom sheet and a top surface opposite the bottom surface, with the top sheet having a slip resistant material positioned on the top surface, and a selective gliding assembly positioned between the top sheet and the bottom sheet and configured to resist sliding of the top sheet in a forward direction relative to the bottom sheet and to permit sliding of the top sheet in at least a rearward direction relative to the bottom sheet. The invention also relates to systems including one or more of such apparatuses and methods utilizing one or more of such systems and/or apparatuses. Various embodiments of the invention are described below.

Referring now to the figures, and initially to FIGS. 1-14, there is shown an exemplary embodiment of a device or apparatus 10 for use in positioning a person in a seated position, such as a patient having limited mobility. As shown in FIG. 1, the apparatus 10 generally includes a first (or bottom) member 20 and a second (or top) member 40 that may be connected to each other at the respective front edges 21, 41 and/or the rear edges 22, 42 of the members 20, 40, as well as a selective gliding assembly 60 positioned between the members 20, 40. For reference purposes, the front edges 21, 41 of the bottom and top members 20, 40 are positioned proximate a front end 11 of the apparatus 10, and rear edges 22, 42 of the bottom and top members 20, 40 are positioned proximate a rear end 19 of the apparatus 10. The selective gliding assembly 60 is configured to resist sliding of the top member 40 in a forward direction relative to the bottom member 20 and to permit sliding of the top member 40 in at least a rearward direction relative to the bottom member 40.

Figure 5:
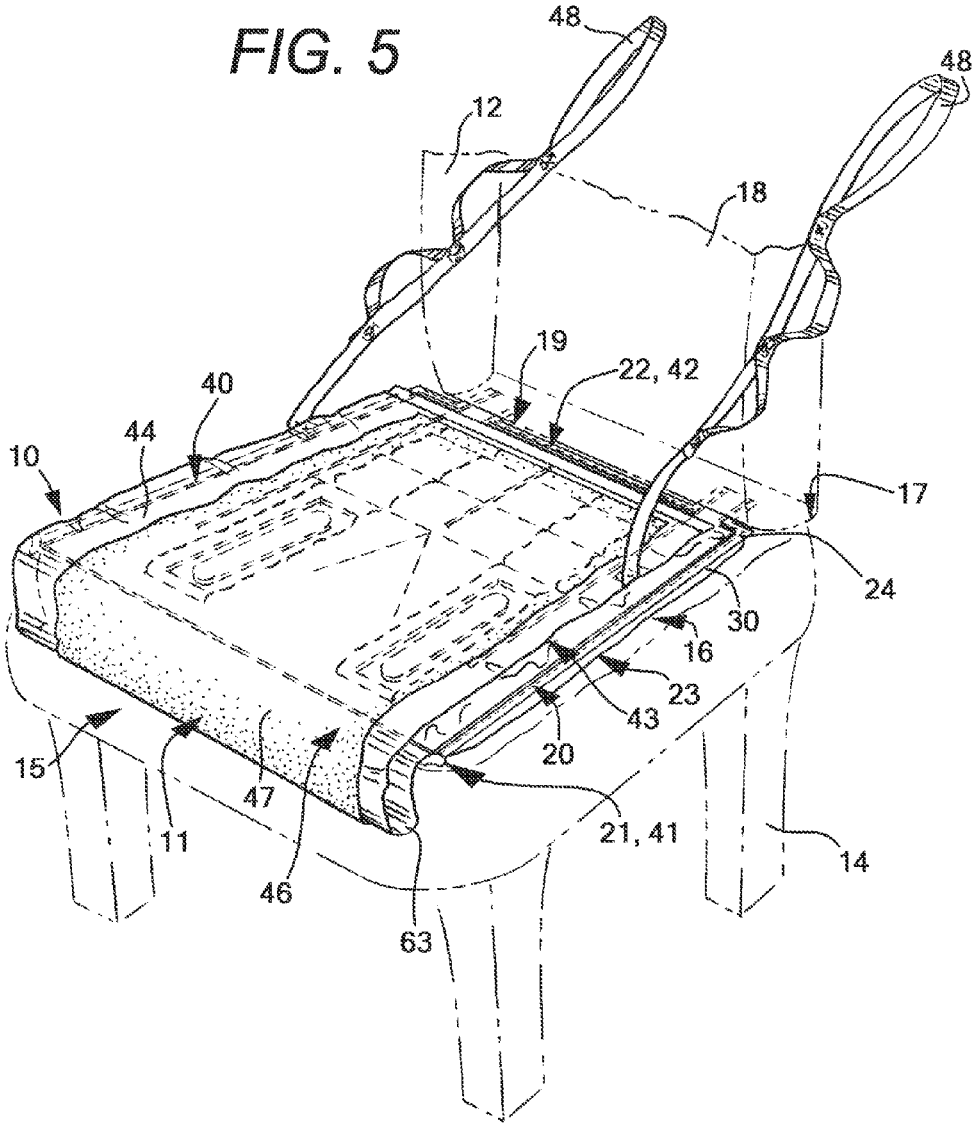
FIG. 5 is a perspective view of the apparatus of FIG. 1, shown positioned on the chair in a forward position.
Figure 6:
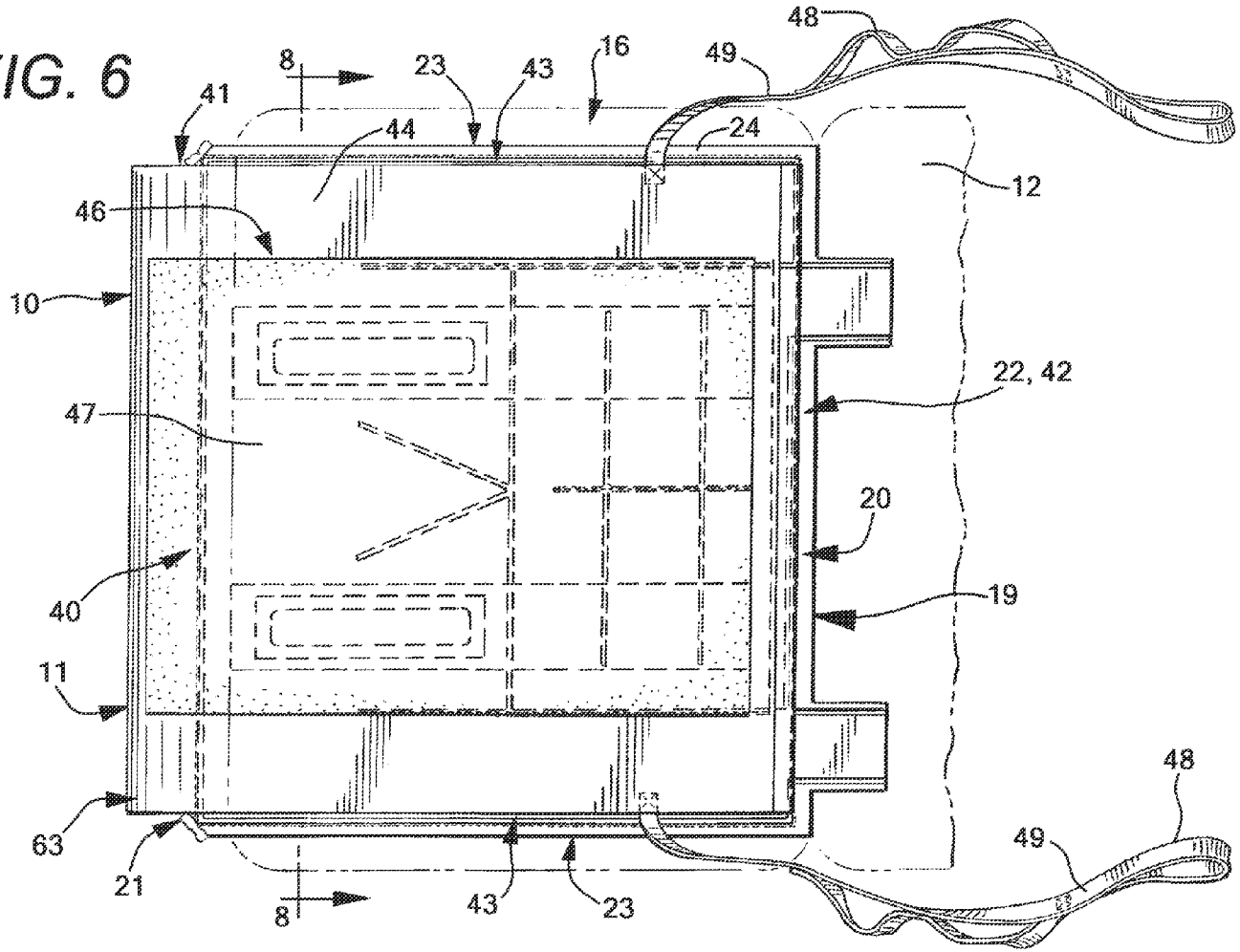
FIG. 6 is a top view of the apparatus and chair as shown in FIG. 5.
Figure 7:
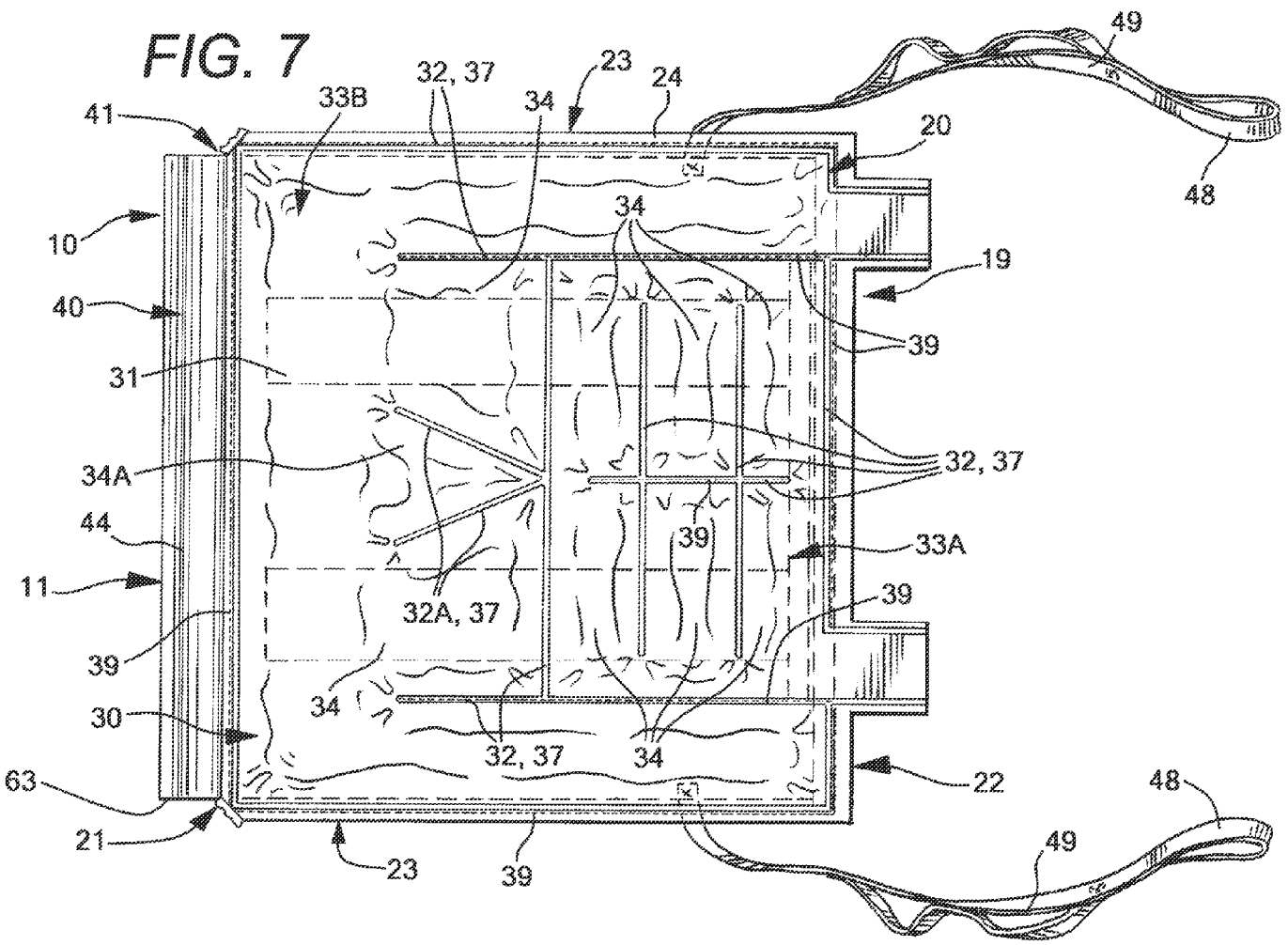
FIG. 7 is a bottom view of the apparatus as shown in FIG. 5, with the chair not shown.
Figure 11:
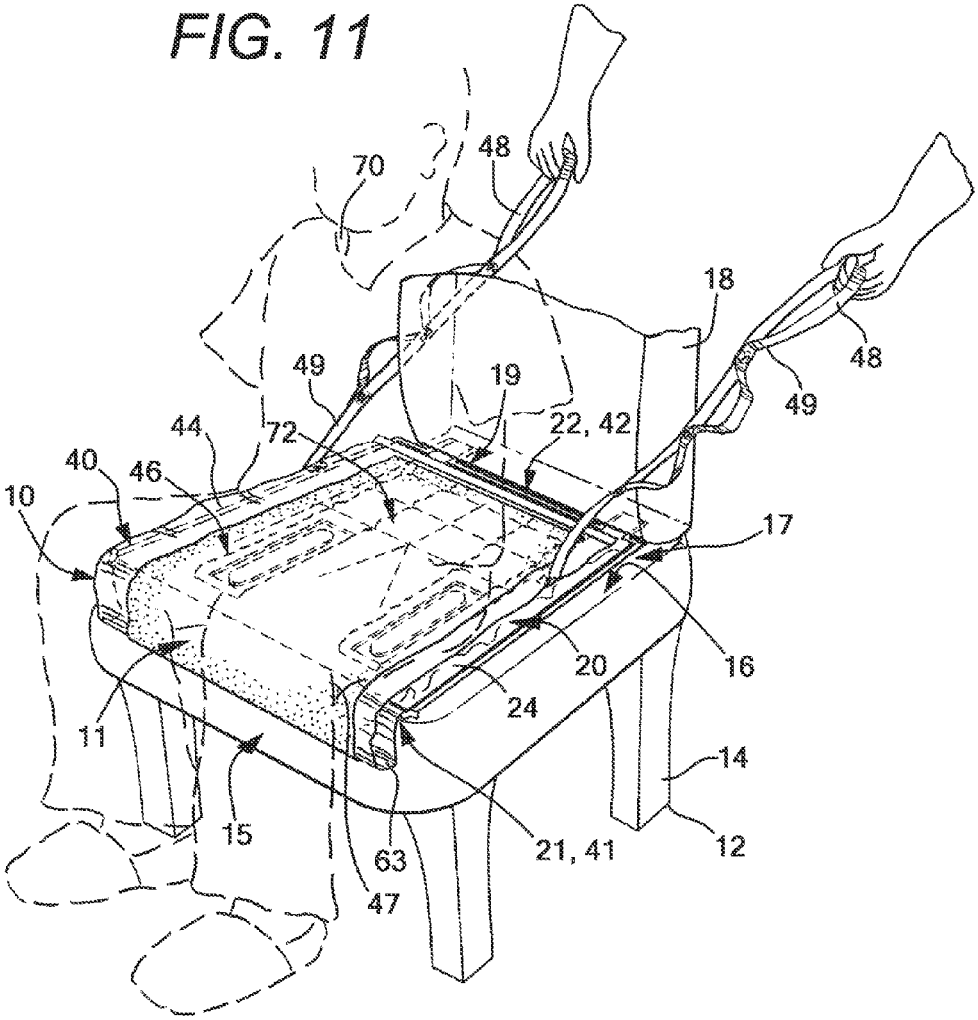
FIG. 11 is a perspective view of the apparatus and chair of FIG. 5, with a person in a seated position on the apparatus and a caregiver assisting in positioning the person.

As shown in FIGS. 5 and 11, the apparatus 10 is configured to be placed on a chair 12 to support a person 70 in a seated position. As used herein, a "chair" may include any type of traditional chair 12, as well as wheelchairs, couches, reclining chairs, seats for motorized vehicles, benches, or any other support apparatus for supporting a person in a seated position. The chair 12 generally includes a frame 14 and a supporting surface 16 supported by the frame 14, as shown in FIG. 5. The frame 14 may include legs, such as in a traditional chair embodiment, and/or may include a different type of support, such as a support base, wheels (in the case of a vehicle or wheelchair), or other types of supporting structures. The supporting surface 16 can include a pad or similar structure in various embodiments, and generally includes a front end 15 and a back end 17. The chair 12 may optionally also include a back 18 positioned at or around the back end 17 of the supporting surface 16, arms (not shown), and/or other components known in the art. The back 18 or other components of the chair 12 may be adjustable, as known in the art. It is understood that the apparatus 10 and the components thereof can be used with other types of chairs 12 as well.

An example embodiment of the bottom member 20 is shown in greater detail in FIGS. 1-4 and 8-9, and has a front end or edge 21, a rear end or edge 22, and side ends or edges 23 extending between the front and rear edges 21, 22. In general, the bottom member 20 is configured to be placed above the supporting surface 16 of the chair 16, and includes a cushioning member 30 and a sheet member 24 connected to the cushioning member 30. In the embodiment shown in FIGS. 1-14, the bottom surface of the bottom member 20 (which may be the bottom surface of the cushioning member 30) is configured to be positioned in confronting relation or in direct contact with the supporting surface 16 of the chair. As used herein, "above," "below," "over," and "under" do not imply direct contact or engagement. For example, the bottom member 20 being above the supporting surface 16 means that that the bottom surface of the bottom member 20 may be in contact with the supporting surface 16, or may face or confront the supporting surface 16 and/or be supported by the supporting surface 16 with one or more structures located between the bottom member 20 and the supporting surface 16, such as a pad or cover on one or both of the bottom member 20 and the supporting surface 16. Likewise, "facing" or "confronting" does not imply direct contact or engagement, and may include one or more structures located between the surface and the structure it is confronting or facing. The bottom member 20 also has an engagement surface 25 that includes a portion of the selective gliding assembly 60, such as at least one engagement member 61.

Figure 8:
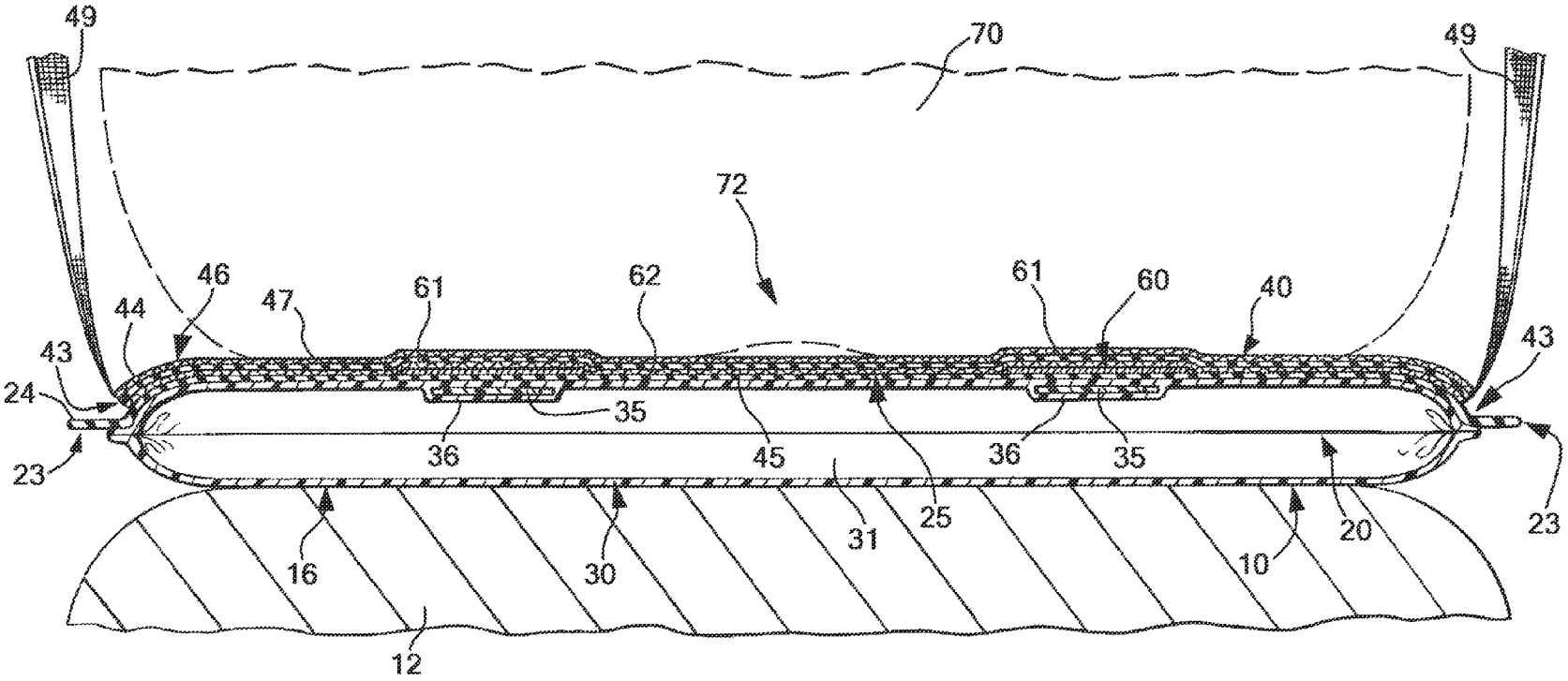
FIG. 8 is a cross-sectional view taken along line 8-8 in FIG. 6, with a person seated on the apparatus.
Figure 9:
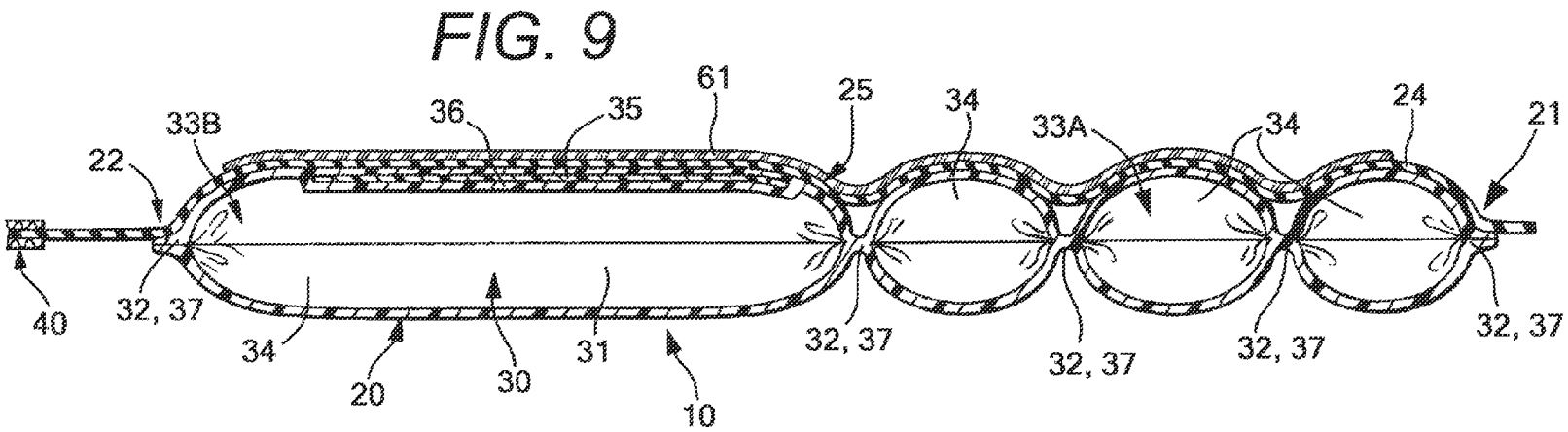
FIG. 9 is a cross-sectional view taken along line 9-9 in FIG. 2.
Figure 10:
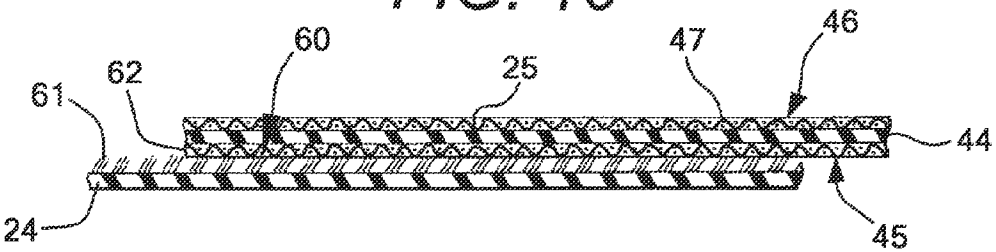
FIG. 10 is a schematic cross-sectional view of two engagement members of a selective glide assembly of the apparatus as shown in FIG. 5.
Figure 10A:
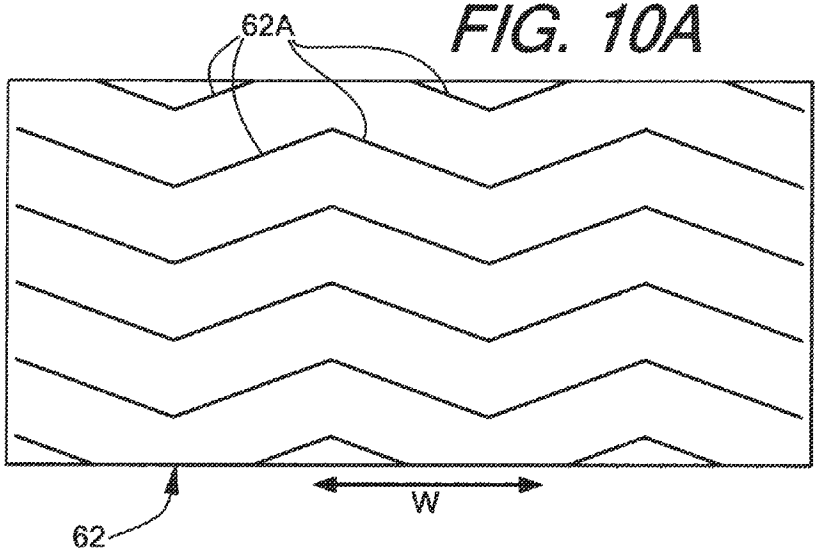
FIG. 10A is a schematic plan view of one engagement member of the selective glide assembly as shown in FIG. 10.
Figure 10B:
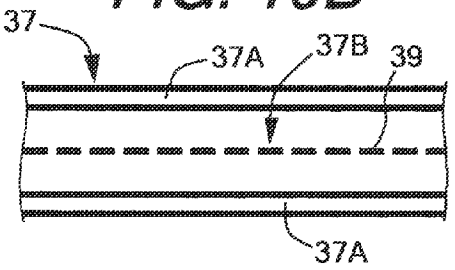
FIG. 10B is a magnified bottom view of a seal of the apparatus as shown in FIG. 7.
Figure 19:
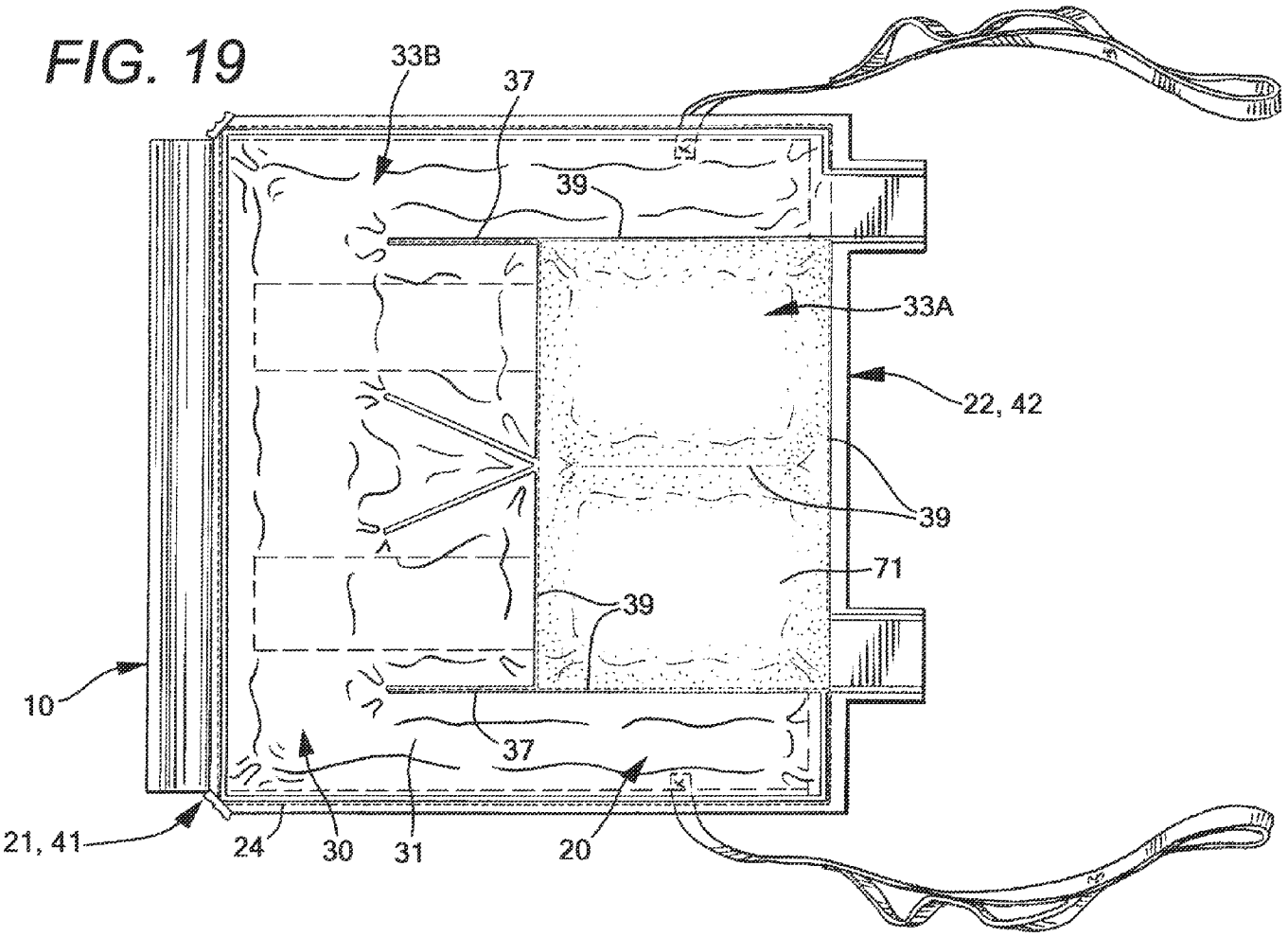
FIG. 19 is a bottom view of another embodiment of an apparatus for positioning a person in a seated position.

The cushioning member 30 in the embodiment shown in FIGS. 1-14 is in the form of a bladder 31 that is configured to be filled at least partially with air or another fluid to provide cushioning. The bladder 31 may be formed of polyurethane or another suitable material, and may include barriers 32 preventing fluid passage, which may be formed by sealing the top and bottom of the bladder 31 together as shown in FIGS. 8-9, or by addition of internal walls or another mechanism. Seals 37 may be used to form the barriers 32 in one embodiment, such as RF seals, heat seals, or other types of seals. In one embodiment, at least some of the seals 37 may be compound seals, as shown schematically in FIG. 10B. Such compound seals 37 include two (or potentially more) parallel sub-seals 37A with a gap 37B defined between the sub-seals 37A. The gap 37B may be used for connection of other components to the bladder 31, such as the bottom sheet 24 or the additional piece of slip resistant material 71 as shown in FIG. 19. Such other components may be connected to the bladder 31 by the use of stitching and/or hot melt adhesive located at the gaps 37B. For example, FIG. 10B illustrates stitching 39 located within the gap 37B of a compound seal 37. The barriers 32 seal the periphery of the bladder 31, and the bladder 31 may also contain internal barriers 32 that divide the bladder 31 into a plurality of cells 34, at least some of which may be in fluid communication with each other.

Additionally, in one embodiment, the bladder 31 may have barriers 32 creating two or more internal chambers 33 that are separate from each other. In the embodiment of FIGS. 1-14, the bladder 31 has two separate chambers 33A-B, including a first chamber 33A extending from the rear edge 22 inwardly proximate the center of the bladder 31 and a second chamber 33B extending peripherally around the three inner sides of the first chamber 33A, along both side edges 23 and along the front edge 21 of the bottom member 20. The first chamber 33A in this embodiment may have an inflation volume of approximately 1.5 L, and the second chamber 33B may have an inflation volume of approximately 4.5 L. Each of the chambers 33A-B is further divided into a plurality of cells 34 in fluid communication with each other in this embodiment by additional internal barriers 32. The second chamber 33B in this embodiment also has a triangularly-shaped cell 34A located near the front edge 21 and formed by a V-shaped barrier 32A, the function of which is described below. Each of the chambers 33A-B has a separate valve 38 in this embodiment for filling and/or emptying the chambers 33A-B. It is understood that the valve(s) 38 may include one-way flow structure to permit filling and resist deflation, as known in the art. The bladder 31 may be provided as a product in the fully inflated configuration with the valves 38 sealed shut in one embodiment, or may be provided in a deflated configuration in another embodiment. In additional embodiments, the bladder 31 may be divided up in a different manner, such as different configurations of chambers 33 and/or cells 34, or may not contain cells 34 or chambers 33. In further embodiments, the cushioning member 30 may not contain other structures in addition to or in place of a bladder, for example a solid or semi-solid cushioning structure, which may contain foam, gel, or other cushioning material, as well as other cushioning structures.

The bottom member 20 may also include one or more stiffening members 35 positioned proximate the front edge 21 and providing increased rigidity to the cushioning member 30 and the first member 20 as a whole, as illustrated in greater detail in FIGS. 5-6 and 8-9. In the embodiment shown in FIGS. 1-14, the cushioning member 30 includes two stiffening members 35 in the form of elongated beams that extend in the forward direction (i.e. in the directly between the front edge 21 and the rear edge 22), generally parallel to the side edges 23. The stiffening members 35 may be formed of a rigid polymeric material (including polymer-containing composites) in one embodiment, or other materials such as metallic materials in another embodiment. In alternate embodiment, the stiffening member(s) 35 may be contained in pockets on the outside of the cushioning member 30, or may be connected to the bottom member 20 in another configuration. The stiffening members 35 extend to points proximate the front edge 21, and the added rigidity assists in holding the bottom member 20 in place while a person is in the seated position or being placed in the seated position, by resisting the front edge 21 of the bottom member 20 from bending, folding, or rolling backward. In this embodiment, the stiffening members 35 are contained within pockets 36 within the bladder 31 that may be connected to the bladder 31 by adhesive, heat sealing, stitching, or other techniques. The stiffening member(s) 35 may have a different configuration and/or structure and perform a similar function in another embodiment, or may be absent entirely. For example, in another embodiment, the stiffening member(s) 35 may be positioned closer or farther from the front edge 21 of the bottom member 20. As another example, the stiffening member(s) 35 may have a greater or smaller length, and may extend substantially across the entire length of the bottom member 20, to a point proximate the rear edge 22, in one embodiment.

Figure 2:
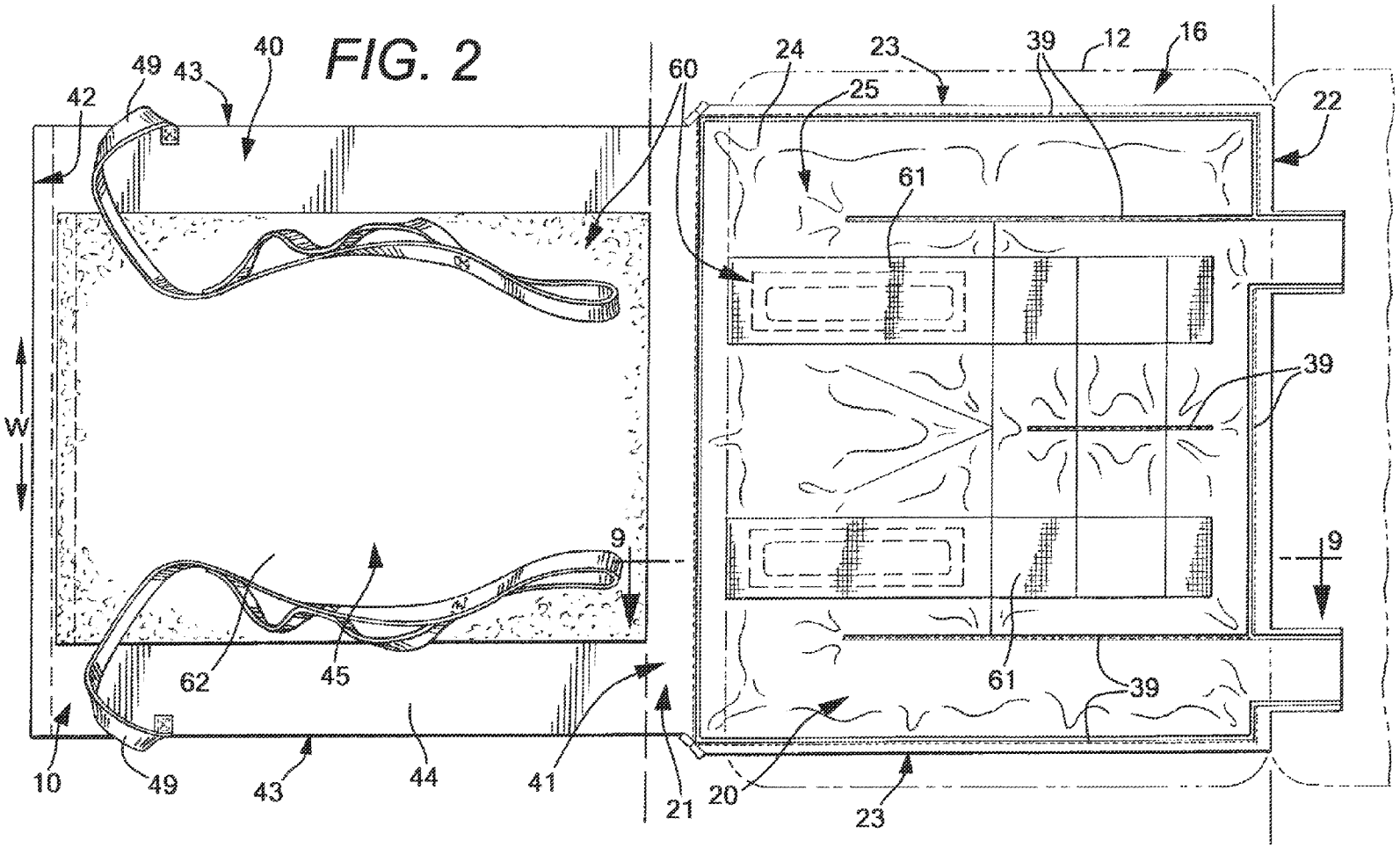
FIG. 2 is a top view of the apparatus of FIG. 1.
Figure 3:
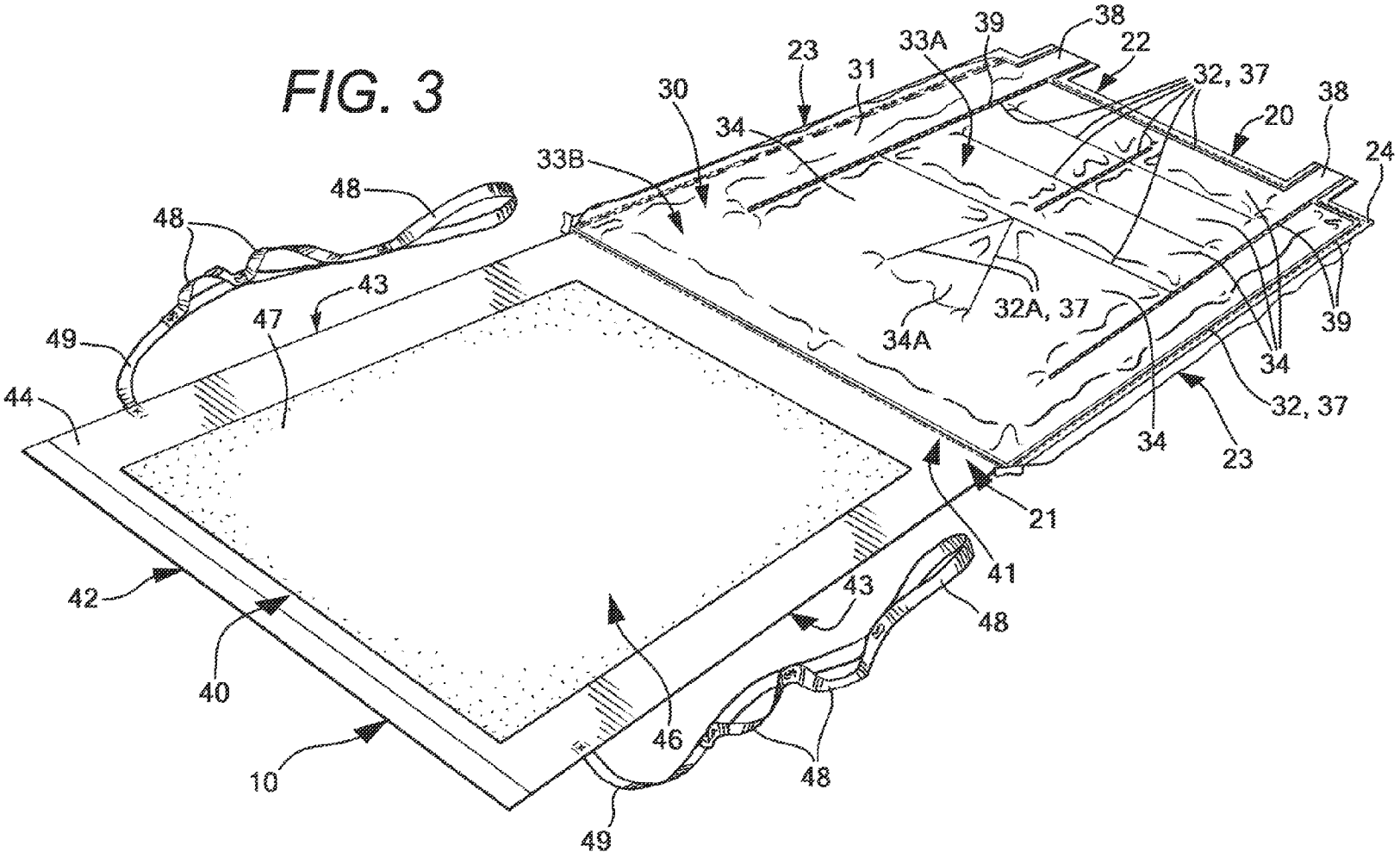
FIG. 3 is a bottom perspective view of the apparatus of FIG. 1.
Figure 4:
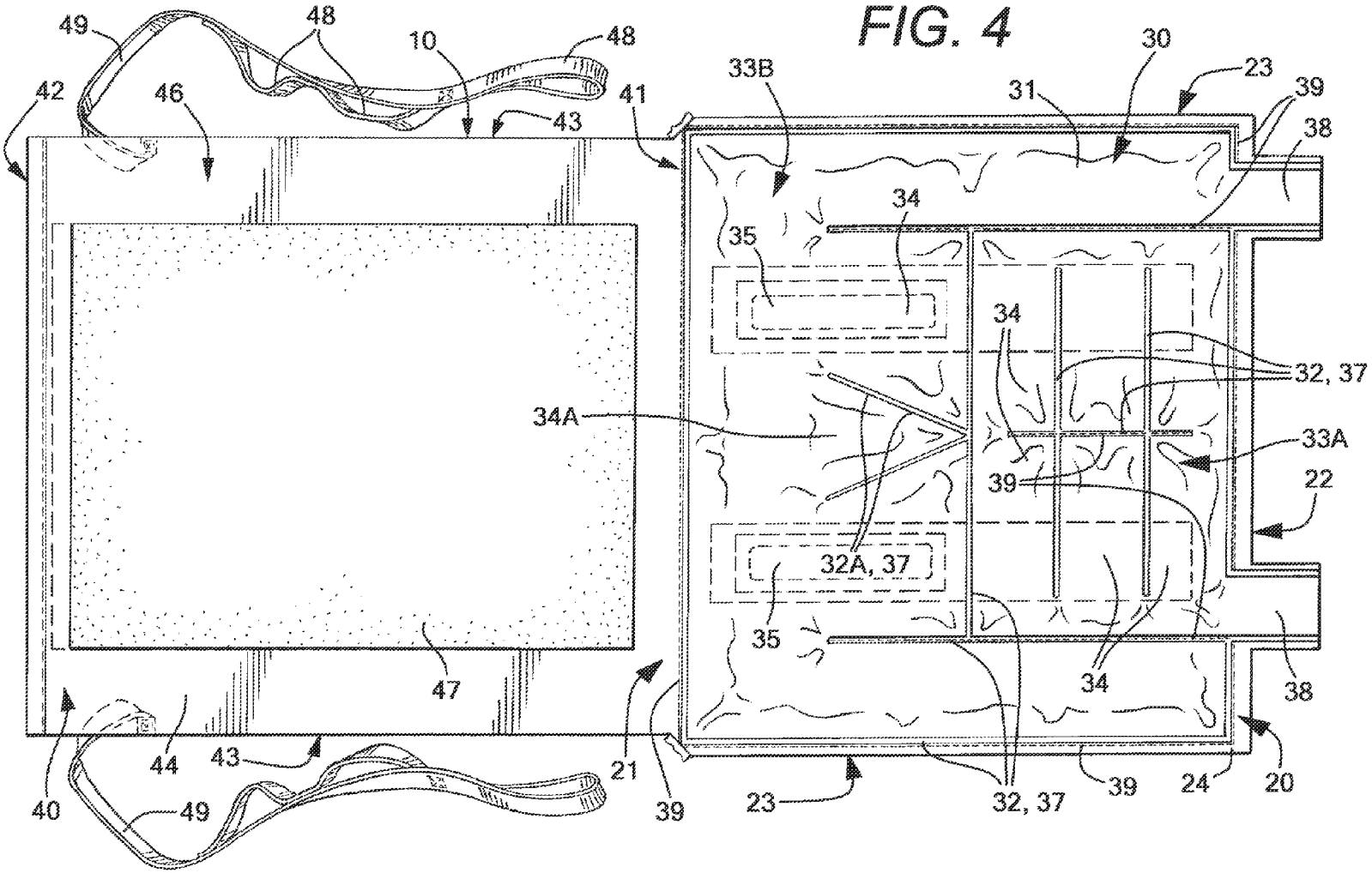
FIG. 4 is a bottom view of the apparatus of FIG. 1.

The sheet member 24, also referred to as the bottom sheet 24, is flexible and foldable, and has a top surface forming the engagement surface 25 and a bottom surface connected to the cushioning member 30. In one embodiment, the bottom sheet 24 is connected around the perimeter of the cushioning member 30 and at several points in the interior of the cushioning member 30 by stitching to the material of the bladder 31. Other connection techniques can be used, including heat sealing, RF sealing, adhesives, etc. At least some heat or RF seals may function both to connect the bottom sheet 24 to the cushioning member 30 and to create barriers 32 within the bladder 31 in one embodiment. Several of the seals 37 of the bladder 31 may serve as connection points for connecting the bottom sheet 24 to the cushioning member 30, such as by the use of compound seals 37 as shown in FIG. 10B. In the embodiment of FIGS. 1-14, the bottom sheet 24 may be connected to the cushioning member by stitching 39 that runs around the exterior of the bladder 31 and along three of the internal seals 37, as seen in FIGS. 1 and 2. In other embodiments, stitching 39 may be located in different positions. The bottom sheet 24 extends to the front, rear, and side edges 21, 22, 23 and defines the front, rear, and side edges 21, 22, 23 in this embodiment.

As seen in FIGS. 1-4, the bottom sheet 24 in this embodiment is rectangular, having four peripheral edges 21, 22, 23, but could be a different shape in other embodiments. In the embodiment of FIGS. 1-14, the bottom sheet 24 is made substantially entirely of a relatively low-friction material, such as polyester and/or nylon (polyamide), although other materials can be used in addition to or instead of these materials. The engagement surface 25 is located on the top of the bottom sheet 24 in this embodiment and includes a portion of the selective gliding assembly 60, such as at least one engagement member 61 connected to and/or forming a part of the bottom member 20. In the embodiment of FIGS. 1-14, the bottom member 20 includes a multi-piece engagement member 61 in the form of elongated strips of a directional glide material, such as a brushed fiber material or other brushed fabric material. For example, the engagement member 61 may be a brushed nylon fiber material (e.g. lint brush material) with about 44-48 wales per inch and about 54-58 courses per inch in one embodiment. Another type of directional glide material may be used in other embodiments, including various ridged fabric and non-fabric materials, such as a flexible ratchet material as used in a zip-tie. The engagement member 61 may be connected to the bottom sheet 24 in a surface-to-surface, confronting relation to form a layered structure in one embodiment, such as by stitching, adhesive, sonic welding, heat welding and other techniques, including techniques familiar to those skilled in the art. Additionally, the strips of the engagement member 61 in this embodiment are smaller than the bottom sheet 24 and cover a portion of the engagement surface 25, and the strips are elongated and extend across the engagement surface 25 in the forward direction. In another embodiment, the bottom member 20 may have one or more engagement members 61 that is/are configured differently, such as a single piece of the directional gliding material, three or more pieces of the directional gliding material, or another material, or such as by extending in a different direction or orientation. In further embodiments, the entire bottom sheet 24 may be covered by the engagement member 61, or the bottom sheet 24 itself may be the engagement member 61, such as being made at least partially from a directional glide material. In one embodiment, as described below, the engagement member(s) 61 of the bottom member 20 may be interchanged or transposed with the complementary engagement member(s) 62 of the top member 40, providing similar functionality for the selective gliding assembly 60.

An example embodiment of the top member 40 is shown in greater detail in FIGS. 1-5, and has a front end or edge 41, a rear end or edge 42, and side ends or edges 43 extending between the front and rear edges 41, 42, as well as a bottom surface 45 and a top surface 46. In general, the top member 40 is configured to be placed in confronting relation to the bottom member 20, such that the bottom surface 45 of the top member 40 confronts and/or engages the engagement surface 25 of the bottom member 20, and the apparatus 10 is configured so that a person may be in a seated position on top of the top surface 46. It is understood that other structures may be located between the person and the top surface 46 in this configuration. In the embodiment of FIGS. 1-14, the top member 40 includes a sheet member or top sheet 44 that defines the edges 41, 42, 43 and the top and bottom surfaces 45, 46. As seen in FIGS. 1-5, the top sheet 44 in this embodiment is rectangular, having four peripheral edges 41, 42, 43, but could be a different shape in other embodiments. Additionally, the top sheet 44 may be formed at least partially of the same material as the bottom sheet 24, and may be similar in length (measured between the front and rear edges 41, 42) and/or width (measured between the side edges 43) to the bottom sheet 24.

In one embodiment, the top member 40 may have a gripping or slip resistant material 47 located on the top surface 46 to provide increased resistance to slipping or sliding of the person when seated on the top surface 46, as shown in FIGS. 8 and 11-14. The slip resistant material 47 may be a warp knit tricot material that may be brushed, napped, and/or sanded to raise its pile, which can enhance comfort, and may be made of polyester and/or another suitable material. The slip resistant material 47 can then be treated with a high friction substance, such as a hot melt adhesive or appropriate plastic, which can be applied as a discontinuous coating to promote breathability. The slip resistant material 47 can also be treated with a water repellant, such as PTFE. In other embodiments, the slip resistant material 47 may include any combination of these components, and may contain other components in addition to or instead of these components. In a further embodiment, the slip resistant material 47 may be or include a coating applied to the top member 40, such as a spray coating on the top sheet 44. The slip resistant material 47 is in the form of a single piece of sheet material in the embodiment of FIGS. 1-14 and may be connected to the top sheet 44 in a surface-to-surface, confronting relation to form a layered structure, such as by stitching, adhesive, sonic welding, heat welding and other techniques, including techniques familiar to those skilled in the art. Additionally, the piece of the slip resistant material 47 in the embodiment of FIGS. 1-14 is smaller than the top sheet 44 and covers a portion of the top surface 46. In another embodiment, the slip resistant material 47 may be configured differently, including being connected to the top member 40 in another manner, or being a different size, shape, or orientation. For example, the top member 40 may include multiple pieces of the slip resistant material 47 or a combination of different slip resistant materials 47. The top sheet 44 may be at least partially made from the slip resistant material 47 in one embodiment. In a further embodiment, the top member 40 may not include the slip resistant material 47.

Generally, the slip resistant material 47 has a coefficient of friction that is higher than the coefficient of friction of the material of the top sheet 44 and/or the bottom sheet 24. In one embodiment, the coefficient of friction for the slip resistant material 47 is about 8-10 times higher than the coefficient of friction of the material of the top sheet 44. In another embodiment, the coefficient of friction for the slip resistant material 47 is between 5 and 10 times higher, or at least 5 times higher, than the coefficient of friction of the material of the top sheet 44. The coefficient of friction, as defined herein, can be measured as a direct proportion to the pull force necessary to move either of the materials in surface-to-surface contact with the same third material, with the same normal force loading. Thus, in the embodiments above, if the pull force for the slip resistant material 47 is about 8-10 times greater than the pull force for material of the top sheet 44, with the same contact material and normal loading, the coefficients of friction will also be 8-10 times different. It is understood that the coefficient of friction may vary by the direction of the pull force, and that the coefficient of friction measured may be measured in a single direction.

In the embodiment of FIGS. 1-14, the top member 40 also has a portion of the selective gliding assembly 60, such as at least one engagement member 62 connected to and/or forming a part of the top member 40. The top member 40 in this embodiment includes an engagement member 62 in the form of a single-piece pad of a material that complementarily engages the directional glide material of the engagement member 61 of the bottom member 20 to produce a selective gliding arrangement. In other words, the engagement member 62 may be formed of a material which can engage the directional glide material to glide freely in one direction, such as the rearward direction in the apparatus 10 as shown in FIGS. 11-14, and resist gliding in the opposite direction, such as the forward direction. The material of the engagement member 62 may be a stitched material with a directional stitching pattern that extends primarily in the lateral or width direction of the apparatus 10 (i.e. between side edges 23 or 43, as shown in FIG. 2), such as a herringbone or zig-zag stitching pattern (see FIG. 10A), to assist in allowing the engagement member 62 to glide in the lateral (side-to-side) direction as well. As seen in FIG. 10A, the herringbone stitching pattern shown is relatively open, with links 62A forming angles of 90° or greater, such that each link 62A in the stitching pattern extends farther in the "width" direction than in the "length" direction. In one embodiment, the links 62A may form angles of approximately 120° or approximately 110°-180° (straight line) with each other. Other directional stitching patterns may be utilized, including other directional stitching patterns with links 62A extending farther in the width direction than in the length direction and extending in the width direction of the apparatus 10. In one example, the engagement member 62 may have stitching in the form of a plurality of parallel or substantially parallel lines extending generally in the width direction. In a further example, the engagement member 62 may not use a stitched material, and may alternately use another material having a directionally oriented texture extending primarily in the width/lateral direction, such as by having a ridged or other textured structure. The directionally oriented texture may have a shape and/or orientation that is similar to one of the embodiments of the directional stitching patterns described above. Such a textured structure may be created by various techniques, including weaving, texturing (e.g. physical deformation), or application of a substance such as by printing, deposition, etc., among other techniques.

One example of a stitched material usable with the engagement member 62 is a loop material (e.g. as used in a hook-and-loop connection), with a directional stitching pattern located on the reverse side of the loop material. This loop material may be connected to the top member 40 with the loop side facing the top sheet 44 and the reverse side facing the bottom member 20 to form the engagement member 62, in one embodiment. The engagement member 62 may be formed of a different material in another embodiment, including, without limitation, a variety of different fabric materials. It is understood that such materials may include a directional stitching pattern. In a further embodiment, the engagement member 62 may be formed of the same material as the bottom engagement member 61. The engagement member 62 may be connected to the top sheet 44 in a surface-to-surface, confronting relation to form a layered structure in one embodiment, such as by stitching, adhesive, sonic welding, heat welding and other techniques, including techniques familiar to those skilled in the art. Additionally, the engagement member 62 in this embodiment is smaller than the top sheet 44 and covers a portion of the bottom surface 45. In another embodiment, the top member 40 may have one or more engagement members 62 that is/are configured differently, such as multiple pieces of the loop material or another material, or such as by extending in a different direction or orientation. In further embodiments, the entire top sheet 44 may be covered by the engagement member 62, or the top sheet 44 itself may be the engagement member 62, such as being made at least partially from the loop material or other complementary material. In one embodiment, as described below, the engagement member(s) 61 of the bottom member 20 may be interchanged or transposed with the complementary engagement member(s) 62 of the top member 40, providing similar functionality for the selective gliding assembly 60.

In the embodiment as illustrated in FIGS. 1-14, the top and bottom members 40, 20 are connected to each other at or around their respective front edges 41, 21 and rear edges 42, 22. The respective side edges 43, 23 of the top and bottom members 40, 20 are free in this configuration, to allow the top member 40 to slide forwardly and rearwardly with respect to the bottom member 20 (subject to limitations by the selective gliding assembly 60 as described below). In one embodiment, the front edge 21 of the bottom member 20 is connected to the front edge 41 of the top member 40 by connecting the bottom sheet 24 to the top sheet 44 at the front edges 21, 41, such as by stitching, adhesive, releasable connecting structure (e.g. hook and loop, snaps or other fasteners, etc.), or another technique. The rear edges 22, 42 may be connected in a similar manner, by connecting the top and bottom sheets 44, 24 at the respective rear edges 41, 21. This configuration forms a continuous piece of the sheet material in one embodiment. Additionally, in one embodiment (as shown in FIGS. 1-6), the bottom member 20 is slightly wider than the top member 40, although this may be changed in other embodiments. In another embodiment, the top and bottom members 40, 20 may be connected at only the front edges 41, 21 or only the rear edges 42, 22 to form a C-shaped structure. It is understood that an intermediate piece of material may be used to form a bridging structure between the top and bottom sheets 44, 24, and that such a bridging structure may be formed of the same material as the top sheet 44 and/or the bottom sheet 24. In an alternate embodiment, the top and bottom sheets 44, 24 may be formed as a single, continuous sheet member that is folded over on itself. In another alternate embodiment, the top and bottom members 40, 20 may additionally or alternately be connected at locations other than one or both ends 21, 22, 41, 42, such as by directly or indirectly connecting at the side edges 23, 43, or by internal connections located inward of the periphery. In further embodiments, the top and bottom members 40, 20 may not be connected to each other, or may be indirectly connected, such as by connecting straps. Additionally, in one embodiment, the top and/or bottom sheets 44, 24 are large enough that slack material 63 is formed overlapping at least one of the front and rear edges of the cushioning member 30 to permit the top member 40 to slide forwardly and/or rearwardly through at least some range of motion, as described below.

As described with respect to the embodiments above, the selective gliding assembly 60 includes one (bottom) engagement member 61 connected to the bottom member 20 and another (top) engagement member 62 connected to the top member 40, where the engagement members 61, 62 are configured to engage each other in a complementary manner to permit sliding of the top member 40 in the rearward direction with respect to the bottom member 20 and to resist sliding of the top member 40 in the forward direction with respect to the bottom member 20. In one embodiment, where the bottom engagement member 61 includes a brushed fiber material (e.g. brushed nylon fiber), and the top engagement member 62 includes a stitched material, the bottom engagement member 61 exerts a force on the top engagement member 62 to resist forward movement of the top member 40, but exerts little to no force on the top engagement member 62 during rearward movement, achieving the selective glide functionality. This engagement is illustrated schematically in FIG. 10. If different materials are used for one or both of the engagement members 61, 62, a different type of complementary engagement between the engagement members 61, 62 may be used. The top member 40 may also be able to slide in one or both lateral directions with respect to the bottom member 20 as well in one embodiment. The use of a directional stitching pattern on the top engagement member 62 may assist in allowing the top member 40 to glide in both lateral directions as mentioned above. In one embodiment, the top engagement member 62 may include a herringbone stitching pattern, as shown in FIG. 10A, although other stitching patterns may also function suitably. In another embodiment, no directional stitching pattern may be used.

In the embodiment of FIGS. 1-14, the width of the pad of the top engagement member 62 is sufficiently wide as to overlap both of the strips of the bottom engagement member 61, so that the top and bottom engagement members 62, 61 have some freedom of lateral movement while still remaining in continuous contact. Additionally, in this embodiment, the strips of the bottom engagement member 61 have sufficient length so that the top and bottom engagement members 62, 61 have some freedom of front-to-back movement while still remaining in continuous contact. In other embodiments, the engagement members 61, 62 may have different configurations, positions, orientations, etc., as described above. For example, in one embodiment, at least one of the engagement members 61, 62 is in the form of a large sheet member that occupies most of the area of the surface on which it is positioned. In this embodiment, the other engagement member 61, 62 may have a large variety of configurations while still remaining in continuous engagement with the large sheet-form engagement member 61, 62. As also described above, the positioning of the engagement members 61, 62 may be reversed or transposed in another embodiment, such as the bottom engagement member 61 including the stitched material and the top engagement member 62 including the brushed fiber material.

The top member 40 may also include one or more handles 48 to facilitate pulling of the top member 40 in the rearward direction. In the embodiment shown in FIGS. 1-14, the top member 40 has handles 48 connected to elongated straps 49 of a strong material that are stitched to the top sheet 44. Each strap 49 has multiple handles 48 along its length to provide different gripping points. In one embodiment, the straps 49 are connected to the top sheet 44 approximately 9 inches from the rear edge 42. The use and function of the handles 48 is further described below. Other types of handles and/or handles in different positions or orientations may be utilized in other embodiments, or the apparatus 10 may have no dedicated handles.

Figure 12:
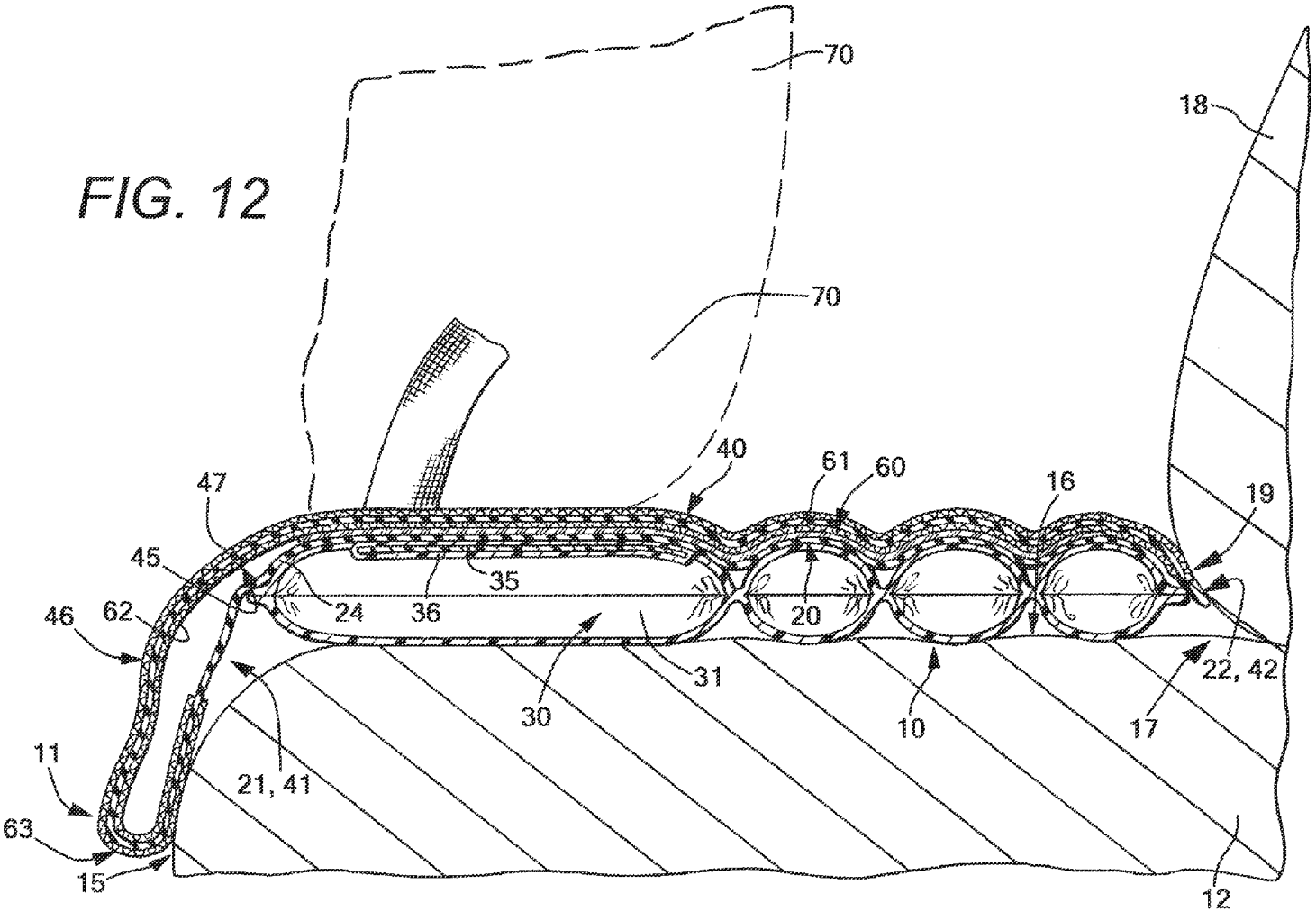
FIG. 12 is a cross-sectional view of the apparatus, chair, and person as shown in FIG. 11, with the apparatus in the forward position.

Exemplary embodiments of methods for utilizing the apparatus 10 are illustrated in FIGS. 11-14. FIG. 5 shows an example of a suitable positioning of the apparatus 10 on the supporting surface 16 of a chair 12. As shown in FIG. 5, in this position, the bottom member 20 is positioned above the supporting surface 16, such that the cushioning member 30 contacts and/or confronts the supporting surface 16, and the bottom sheet 24 is positioned on the opposite side of the cushioning member 30, with the engagement surface 25 facing upward. In this configuration, the rear edge 22 of the bottom member 20 is near the back 18 of the chair 12 and the back end 17 of the supporting surface 16, and the front edge 21 of the bottom member 20 is near the front end 15 of the supporting surface 16. Additionally, in this configuration, the top member 40 is positioned above the bottom member 20, with the bottom surface 45 contacting and/or confronting the engagement surface 25 of the bottom member 20, such that the engagement members 61, 62 engage each other to form the selective gliding assembly 60 as described above. As shown in FIGS. 5 and 11-12, the slack material 63 is positioned primarily at the front end 15 of the supporting surface 16 to allow freedom to move the top member 40 rearwardly. The apparatus 10 should be properly positioned prior to use by the person (e.g. patient) 70, such as shown in FIG. 5, to avoid the necessity of properly positioning the apparatus after the person 70 is seated on top of the apparatus 10. In one embodiment, the apparatus may have an indicator (not shown), such as a visible line or other mark, for use in positioning the apparatus 10. For example, the sheet top member 40 may have a mark that is configured to be aligned with a marker (not shown) on the bottom member 20 or with a specified point on the chair 12, to indicate the proper initial positioning. As another example, the apparatus 10 may have a mark that is configured to illustrate proper positioning of the person 70, such as for proper lateral and/or forward-rearward positioning.

Figure 13:
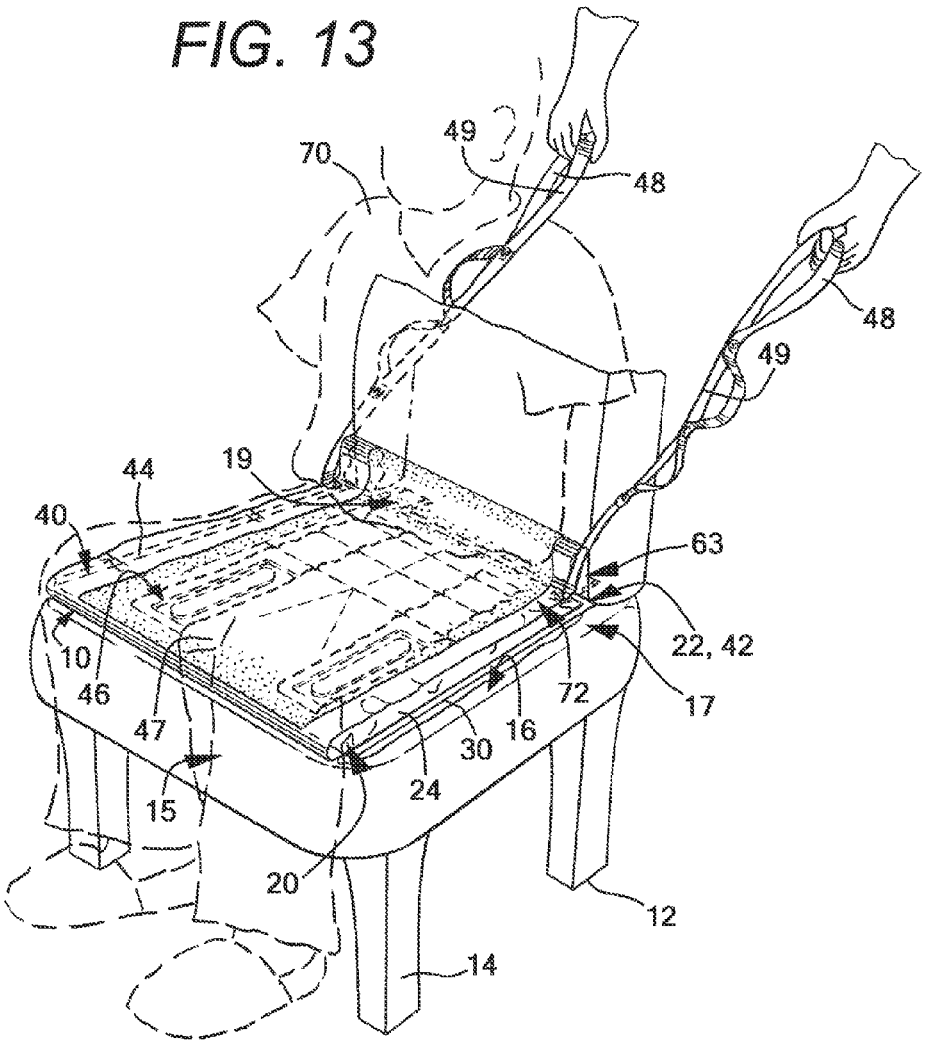
FIG. 13 is a perspective view of the apparatus, chair, and person as shown in FIG. 11, with the apparatus in a rearward position.
Figure 14:
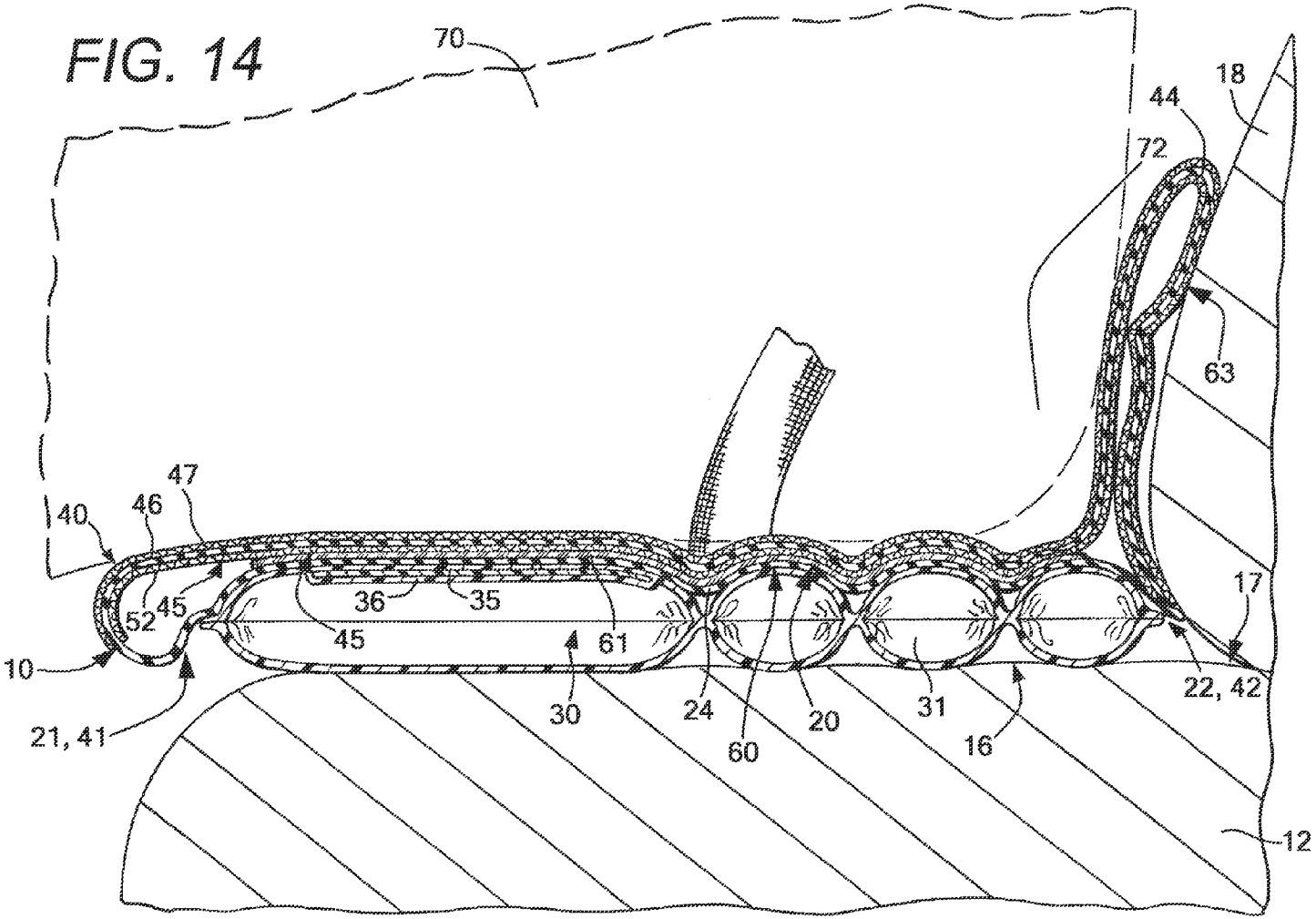
FIG. 14 is a cross-sectional view of the apparatus, chair, and person as shown in FIG. 13.

After the apparatus 10 is positioned in a suitable position (e.g. FIG. 5), a person 70 can then be placed on top of the apparatus 10 in a seated position, so that the person 70 is resting in the chair 12 in the seated position and is supported by the supporting surface 16 and/or the back 18 (if present). Depending on the person's mobility, the person 70 may be positioned by himself/herself or with at least some assistance from others, such as healthcare professionals. In this configuration, the person's seat 72 may be positioned above and confronting the top surface 46 of the top member 40, and may be in contact or engagement with the top surface 46 and the slip resistant material 47 as shown in FIGS. 8 and 11-14. It is understood that one or more additional members may be positioned between the top surface 46 and the person 70 in one embodiment, and it is further understood that contact or engagement with clothing worn by the person 70 may be considered contact or engagement "with" the person 70 as used herein. As shown in FIGS. 11-12, the apparatus 10 is in a forward position at this point, with the slack material 63 located around the front end 15 of the supporting surface 16. The top member 40 can then be moved rearwardly to a rearward position, as shown in FIGS. 13-14, to move the person's seat 72 rearwardly in the chair 12, toward the back end 17 of the supporting surface 16. This rearward movement can be accomplished by grasping and pulling on the handles 48 and/or straps 49 in one embodiment (see FIGS. 11 and 13), and can additionally or alternately be accomplished by pulling or pushing on the person 70 and/or the top member 40 in other embodiments. In the rearward position, the person 70 may sit up straighter in the chair 12. The engagement of the engagement members 61, 62 of the selective glide assembly 60 permits this rearward movement and resists movement of the top member 40 and the person 70 forwardly after being positioned in the rearward position. The slip resistant material 47, if present, can resist sliding or other movement of the person 70 with respect to the top member 40 before and during the rearward movement, and can also combine with the resistance of the selective glide assembly 60 to resist the person 70 sliding forward when seated for a time period. Once in the rearward position, at least some of the slack material 63 is positioned near the back end 17 of the support surface 16, as shown in FIGS. 13 and 14.

The person 70 can be removed from the seated position at any time, and the apparatus 10 can then be returned to the forward position or moved to a different chair 12 for re-use when the person 70 is positioned again in the seated position. It is understood that multiple forward and rearward positions may exist for the apparatus 10, and that the amount of rearward movement may depend on many factors, including the structure of the chair, the size and positioning of the patient, the comfort level and desires of the patient, or other factors.

Figure 15:
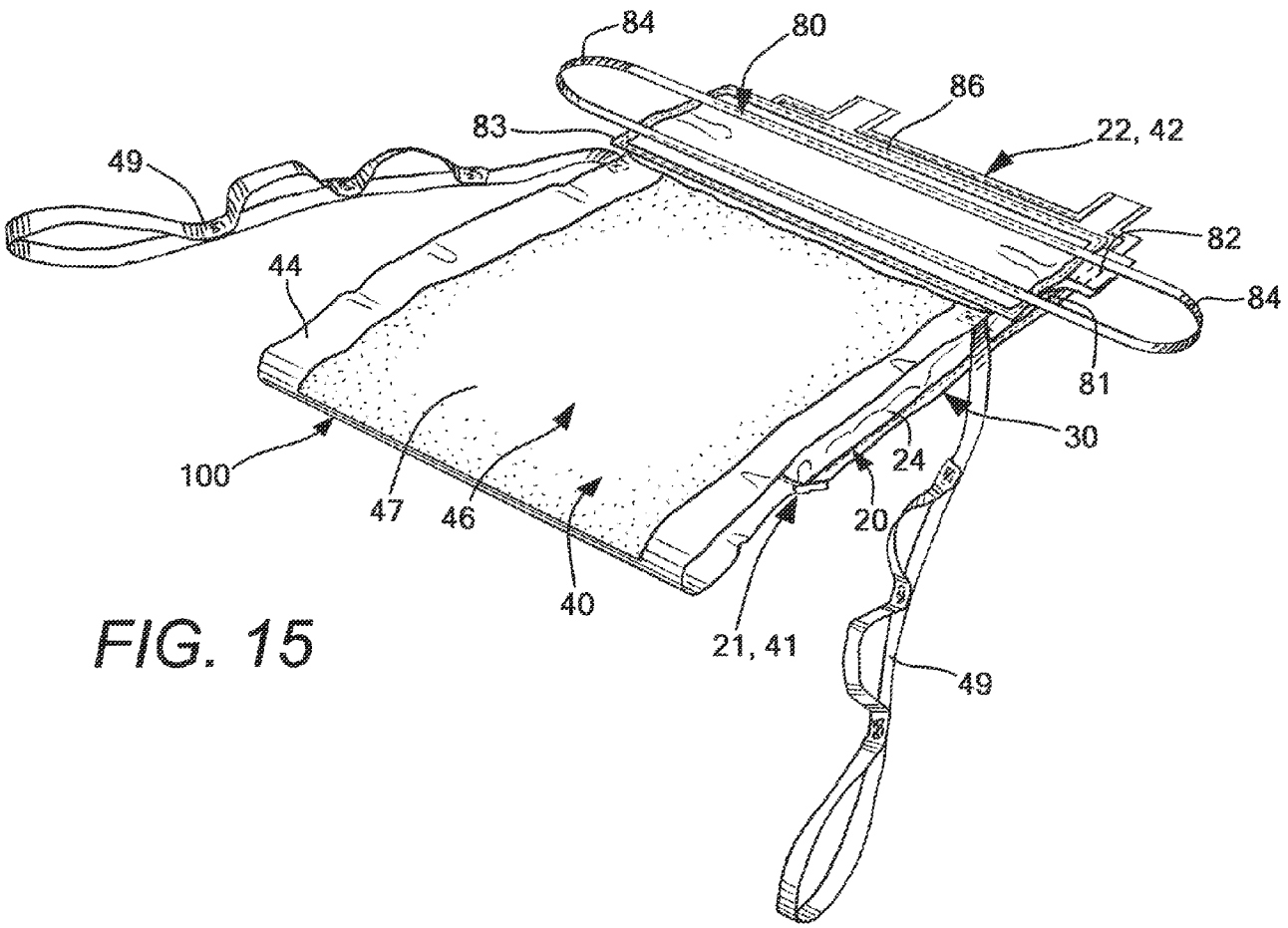
FIG. 15 is a perspective view of another embodiment of an apparatus for positioning a person in a seated position.
Figure 16:
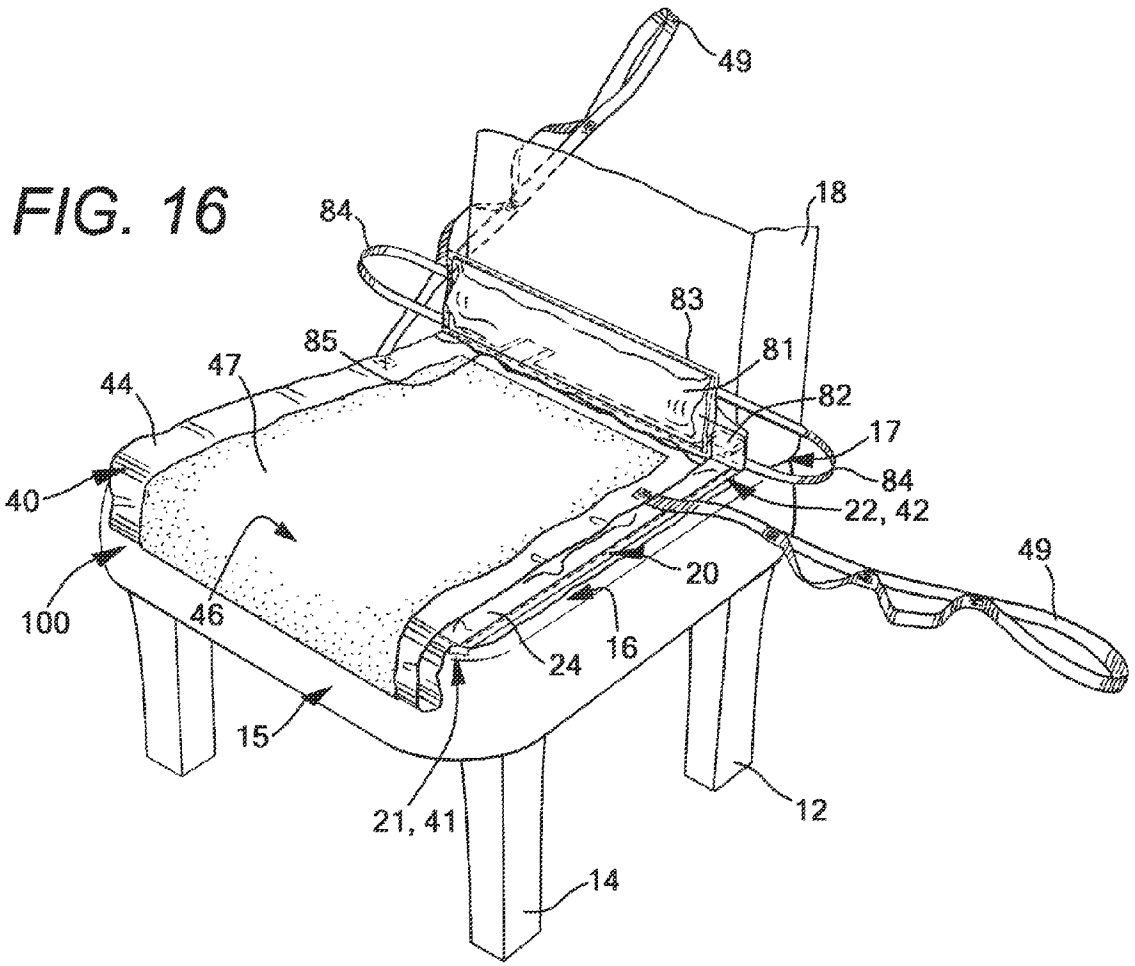
FIG. 16 is a perspective view of the apparatus of FIG. 15, shown positioned on a chair.
Figure 17:
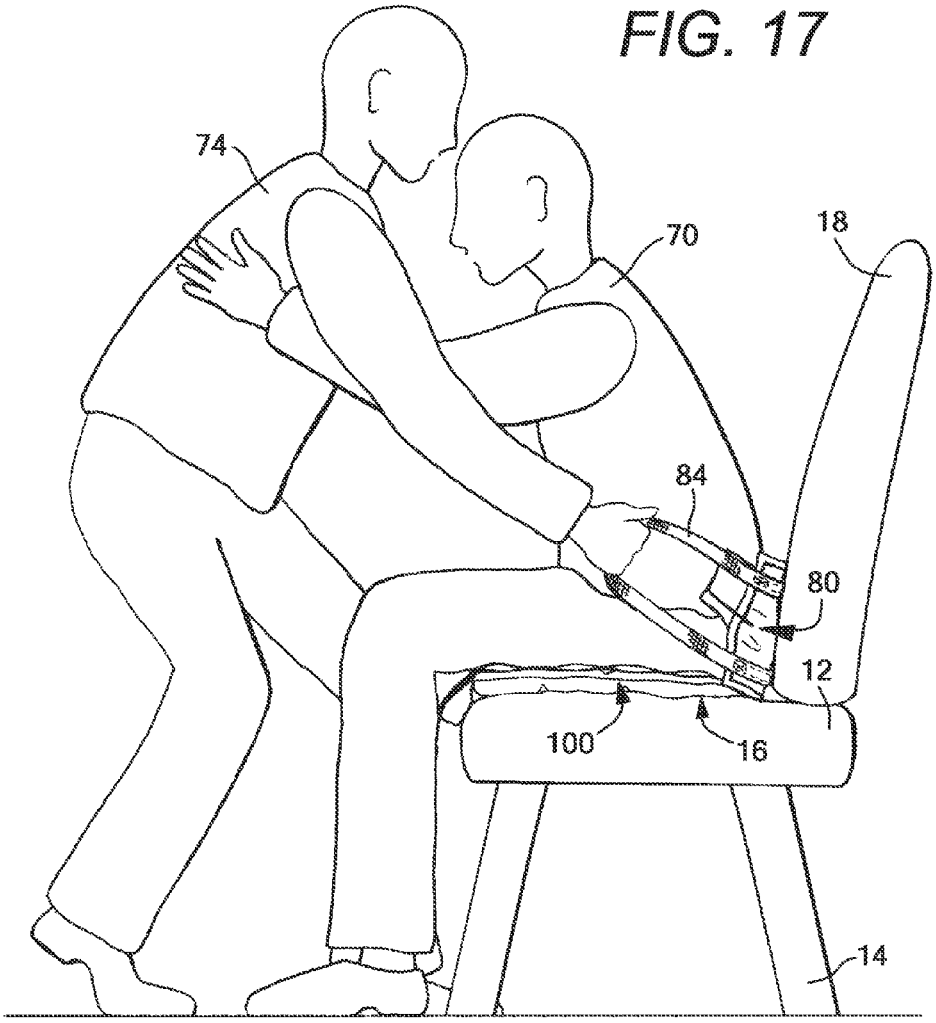
FIG. 17 is a side view of the apparatus and chair of FIG. 16, shown with a person seated on the apparatus and a caregiver assisting in positioning the person by moving the person forward.

FIGS. 15-17 illustrate an additional embodiment of a device or apparatus 100 according to aspects of the present invention, which is usable with the various embodiments of methods as described above. In the embodiment of FIGS. 15-17, the apparatus 100 includes components that are primarily the same or substantially similar to the components of the apparatus 10 of FIGS. 1-14. Such similar or identical components are referred to using similar reference numerals, and may not be described again herein for sake of brevity. The apparatus 100 of FIGS. 15-17 also includes a second cushioning member 80 connected to at least one of the top and bottom members 40, 20 proximate the rear end 19 of the apparatus. In the embodiment illustrated in FIGS. 15-17, the second cushioning member 80 is completely separate from the cushioning member 30 of the bottom member 20 and includes a second bladder 81 configured to be filled with fluid (e.g. air), with a valve 82 for filling and/or emptying the second bladder 81. The second bladder 81 consists of a single chamber in this embodiment, but may include multiple cells and/or chambers in another embodiment. As described above with respect to the cushioning member 30, the second cushioning member 80 may be provided in an inflated configuration with the valve 82 sealed or may be provided in a partially or completely deflated configuration in various embodiments. Additionally, the second cushioning member 80 is connected to a flap 83 that may be formed of the same material as the top and bottom sheets 44, 24, such as by heat sealing or another technique described above. As shown in FIGS. 15-17, in one embodiment, the second cushioning member 80 is attached to the top member 40 by connecting the flap 83 to the top sheet 44, such as by stitching, adhesive, or other technique described above. The flap 83 is flexible and is connected along only one edge 85, allowing the second cushioning member 80 to be folded forwardly or rearwardly in this embodiment. The second cushioning member 80 is configured to extend upward from the rear end 19 of the apparatus 100, along the back 18 of the chair 12, to provide support for the lower back of the person 70 seated on the apparatus 100, as illustrated in FIGS. 15-17.

In the embodiment of FIGS. 15-17, the second cushioning member 80 is connected proximate the rear edge 42 of the top member 40, so that when the top member 40 is moved backward to position the person 70 in the upright seated position (described above), the second cushioning member 80 will also move toward the back end 17 of the supporting surface 16 and extend upwardly along the back 18 of the chair 12. In this position, the second cushioning member may provide back cushioning and support for the person 70. The slack material 63 may be bunched up partially behind the second cushioning member 80 when the top member 40 is in the rearward position. The second cushioning member 80 may also include handles 84 on its sides in one embodiment, for use in assisting with removing the person 70 from the chair 12 when desired. When it is desired to pull the person 70 forward in the chair 12, such as for moving or standing, a user 74 (e.g. a caregiver) may grasp one or both handles 84 and pull forward to pull the person 70 forwardly and/or upwardly, functioning similar to a gait belt, as shown in FIG. 17. The handles 84 may be made from the same material as the handles 48 and straps 49 of the top member 40 in one embodiment. In other embodiments, certain features and components of the second cushioning member 80 may be changed, and/or the second cushioning member 80 may be connected in a different location and/or orientation. The apparatus 100 may include additional cushioning members in a further embodiment.

Figure 18:
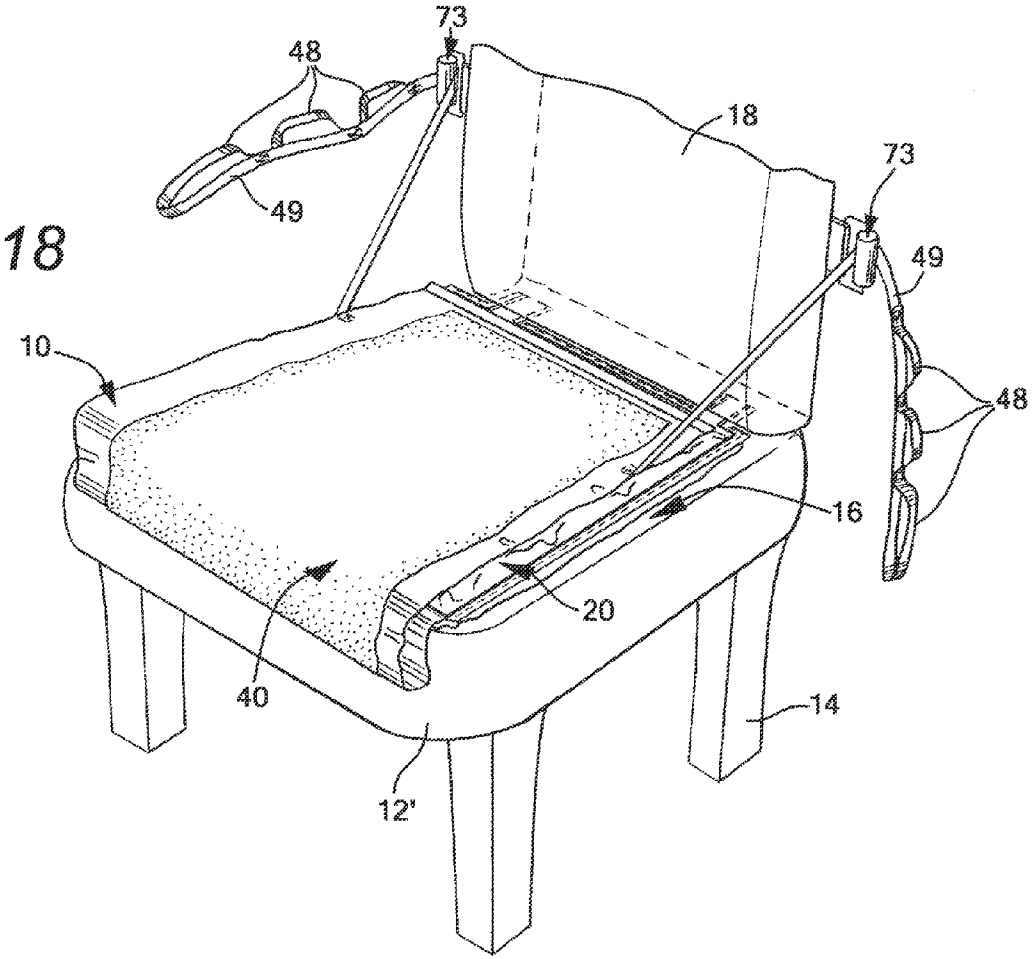
FIG. 18 is a perspective view of the apparatus of FIG. 1, shown positioned on a chair having pulleys for assisting operation of the apparatus.

FIG. 18 illustrates an additional embodiment that is illustrated for use with the apparatus 10 of FIGS. 1-7, but may also be used with the apparatus 100 of FIGS. 15-17 or other embodiments as described herein. In the embodiment of FIG. 18, the apparatus 10 is used with a chair 12' that includes rollers or pulleys 73 that may be engaged by the straps 49 to assist with pulling the person (not shown in FIG. 18) rearwardly on the chair 12'. As can be appreciated from FIG. 18, the straps 49 can be threaded through the pulleys 73 to permit a caregiver to pull the person rearwardly from the front 11 of the apparatus 10, as pulling the ends of the straps 49 forwardly causes the top member 40 to move rearwardly. This configuration can provide benefits such as reducing strain on caregivers, facilitating positioning of persons with decreased mobility by a single caregiver (who is in position to stop forward falling of the person), and positioning persons in chairs 12' that cannot be accessed from the rear. The pulleys 73 are shown as having a vertical axis of rotation in this embodiment, but may have another axis of rotation in another embodiment, including a horizontal axis or an angled axis. In a further embodiment, the pulleys 73 may contain more complex structure to create mechanical advantages, such as additional rollers, gears, etc. In an alternate embodiment, both straps could converge to a single compound pulley connected to the center of the backside of the chair 12'.

FIG. 19 illustrates another embodiment of the apparatus 10 of FIGS. 1-7, which includes a piece of additional slip resistant material 71 on the bottom of the bottom member 20. This additional slip resistant material 71 may be the same material used for the slip resistant material 47 on the top member 40, or may be another material in different embodiments. In the embodiment of FIG. 19, the additional slip resistant material 71 is positioned to cover the bottom side of the first chamber 33A and is connected to the bladder 31 by stitching 39 along several seals 37. As described above, these seals 37 may be compound seals as shown in FIG. 10A. The additional slip resistant material 71 contacts the supporting surface 16 of the chair 12 (not shown in FIG. 19) and can resist sliding of the bottom member 20 relative to the supporting surface 16, such as when seating a person on the apparatus 10, moving the top member 40 rearwardly, or otherwise manipulating the person or the apparatus 10. In other embodiments, the additional slip resistant material 71 may be connected to the bottom member 20 using another connection technique, and/or the additional slip resistant material 71 may have a different size, shape, position, etc.

Figure 20:
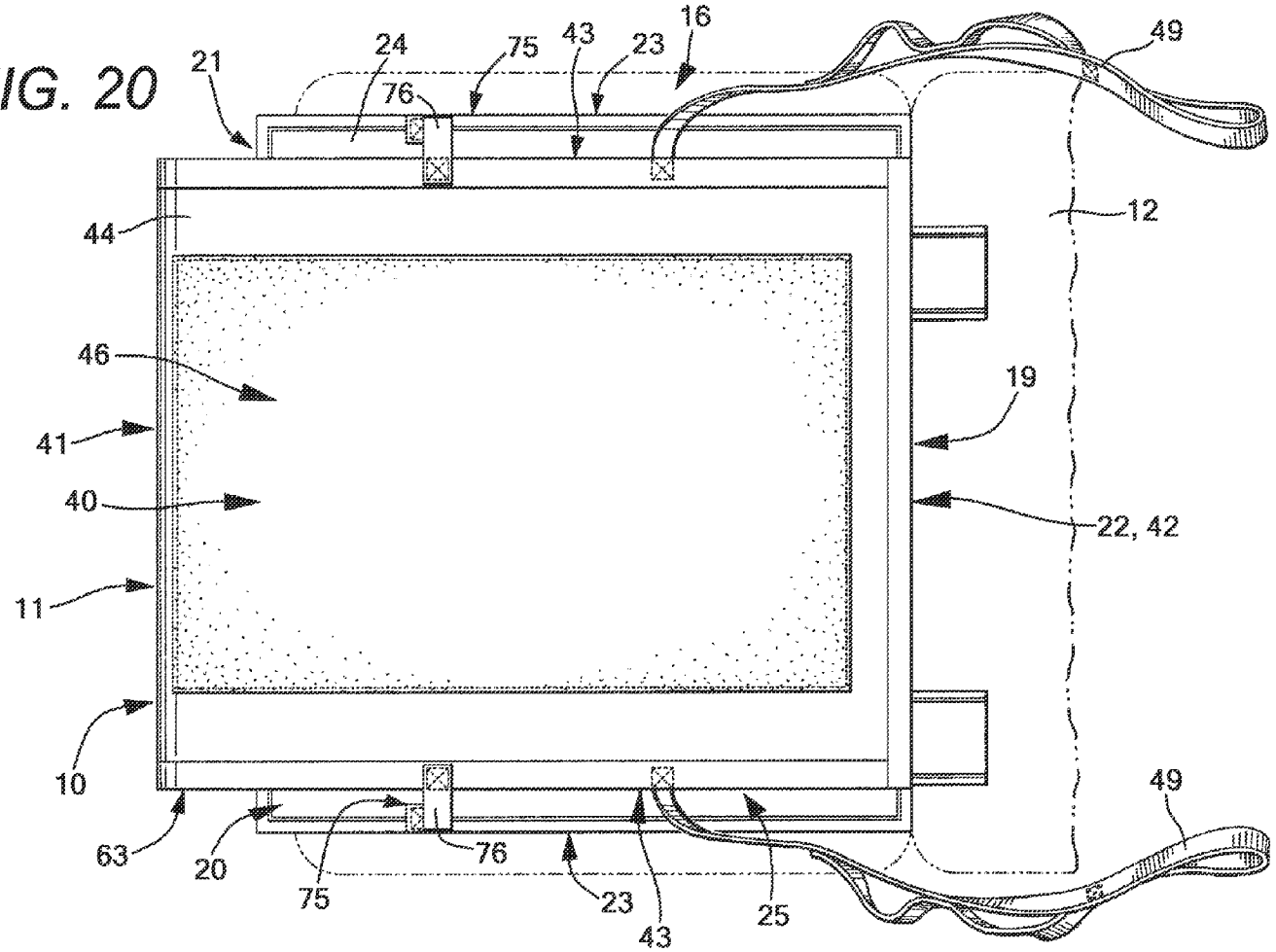
FIG. 20 is a top view of another embodiment of an apparatus for positioning a person in a seated position.
Figure 21:
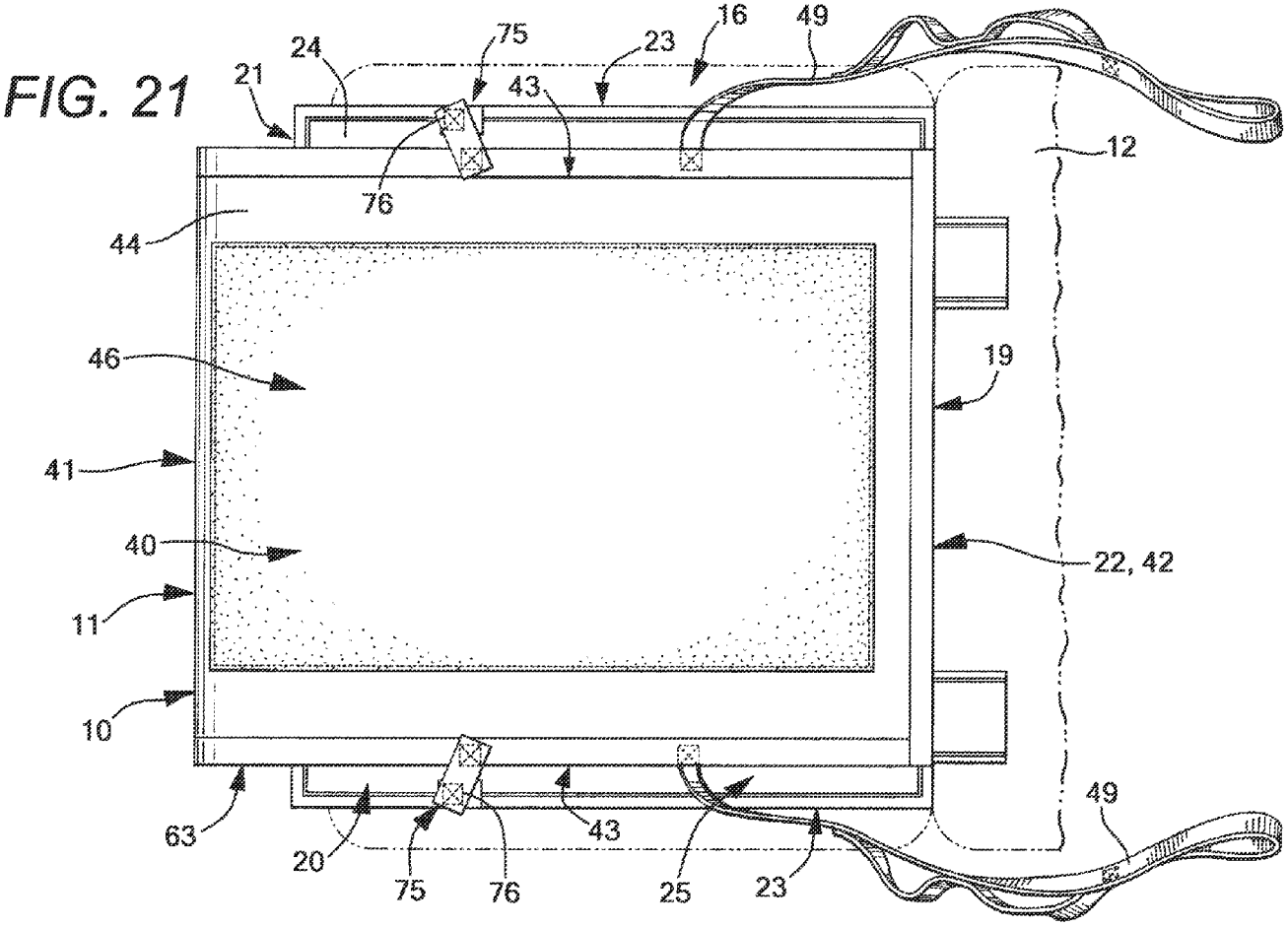
FIG. 21 is a top view of the apparatus of FIG. 20, with a top member of the apparatus being moved slightly in a rearward direction.

FIGS. 20 and 21 illustrates another embodiment of the apparatus 10 of FIGS. 1-7, which includes a movement limiting mechanism 75 that releasably connects the top member 40 to the bottom member 20 and temporarily limits movement of the top member 40 with respect to the bottom member 20 until the mechanism 75 is released. In this embodiment, the movement limiting mechanism 75 is formed by hook and loop connections 76 proximate the side edges 43, 23 of the top and bottom sheets 44, 24 that temporarily limit the movement of the top sheet 44 with respect to the bottom sheet 24. It is understood that the movement limiting mechanism 75 may include one or a greater number of hook and loop connections 76 in other embodiments. These connections 76 resist undesired movement of the top member 40 with respect to the bottom member 20 under small forces, such as forces exerted during shipment, handling, placement of the apparatus 10 on the chair 12, and other actions where movement of the top member 40, particularly in the rearward direction, is not desired. For example, in some circumstances, a caregiver may place a sheet, towel, or similar article over the top of the apparatus 10 prior to use, and such placement may cause rearward movement of the top member 40, such as if the sheet, towel, etc. is tucked under the back 18 of the chair 12. Such rearward movement of the top member 40 may decrease the amount of slack material 63 at the front 11 of the apparatus 10, which may limit the amount of rearward movement that can be achieved once the person 70 is seated on the apparatus 10. The movement limiting mechanism 75 can limit this movement to only slight movements, as shown in FIG. 21. When greater rearward force is exerted on the top member 40, such as by pulling on the straps 49 to position the seated person 70 rearwardly, the strength of the hook and loop connection 76 is exceeded, and the connection 76 releases to allow rearward movement. The hook and loop connection 76 can be reconnected for re-use. In the embodiment of FIGS. 20-21, the movement limiting mechanism 75 is located more proximate the front edge 11 of the apparatus 10, which reduces the total length of the top sheet 44 that can be displaced before the connection 76 stops the movement. For example, the hook and loop connection 76 may be positioned approximately ¼ to ⅓ of the distance from the front edge 21 to the rear edge 22 of the bottom member 20 in one embodiment. In further embodiments, the movement limiting mechanism 75 may have a different form, including: a different type of releasable and reconnectable mechanism, such as snaps, ties, flexible tabs, etc.; a breakable connection such as a temporary stitch, a thin piece of material, a weak adhesive, or other breakable or frangible connection; or a combination of such connections. Additionally, the movement limiting mechanism 75 may be located in a different position in another embodiment, and the mechanism 75 may include a greater or smaller number of connections between the top and bottom members 40, 20.

The various embodiments of apparatuses 10, 100 and methods described herein provide benefits and advantages over existing technologies. For example, the apparatuses 10, 100 allow a person 70 with limited mobility to be quickly and easily positioned in an upright seated position, and resists the person 70 from sliding downwardly and forwardly after desired positioning. The handles 48 on the apparatuses 10, 100 facilitate this positioning and lessen strain on caregivers trying to move the person 70, and the slip resistant material 47 and the selective glide assembly 60 assist in resisting slipping or sliding of the person 70. The cushioning member 30 provides added comfort to the seated person 70 and also assists in proper positioning. For example, the triangular cell 34A defined by the V-shaped barrier 32A of the cushioning member 30 forms a hump or saddle-like shape when inflated, to further resist forward movement of the seated person 70. As another example, the use of multiple cells 34 in the first chamber 33A allows air to be distributed between the left and right sides as needed to achieve even pressure distribution on the user's back side, and also allows air to escape forward and prevent back-trapped air when the person is pulled into position, to further achieve even pressure distribution. The second chamber 33B may achieve even pressure distribution in a similar manner. This even pressure distribution, in turn, can help protect against pressure ulcers in patients using the apparatus 10, 100. Further, the use of the second cushioning member 80 in the apparatus 100 of FIGS. 15-17 increases comfort and assists in removing the person 70 from the chair 12. Still further, the use of lateral gliding between the top and bottom members can allow for greater freedom of movement by seated persons, as well as reduce the likelihood of the person moving to a position where the apparatus loses functionality and reduce shearing forces on the person's skin from sliding against the top member. Still other benefits and advantages over existing technology are provided by the apparatuses and methods described herein, and those skilled in the art will recognize such benefits and advantages.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "first," "second," "top," "bottom," etc., as used herein, are intended for illustrative purposes only and do not limit the embodiments in any way. Additionally, the term "plurality," as used herein, indicates any number greater than one, either disjunctively or conjunctively, as necessary, up to an infinite number. Further, "providing" an article or apparatus, as used herein, refers broadly to making the article available or accessible for future actions to be performed on the article, and does not connote that the party providing the article has manufactured, produced, or supplied the article or that the party providing the article has ownership or control of the article. Accordingly, while specific embodiments have been illustrated and described, numerous modifications come to mind without significantly departing from the spirit of the invention and the scope of protection is only limited by the scope of the accompanying Claims.

What is claimed is:

1. An apparatus for use with a chair having a supporting surface, the apparatus comprising:

a cushioning member adapted to be placed above the supporting surface of the chair;

a bottom sheet connected to the cushioning member and having an engagement surface opposite the cushioning member;

a top sheet having a bottom surface positioned in confronting relation to the engagement surface of the bottom sheet and a top surface opposite the bottom surface, the top sheet having a slip resistant material positioned on the top surface; and a selective gliding assembly positioned between the top sheet and the bottom sheet, the selective gliding assembly comprising a first engagement member positioned on the engagement surface of the bottom sheet and a second engagement member positioned on the bottom surface of the top sheet, wherein the first engagement member and the second engagement member engage each other to resist sliding of the top sheet in a forward direction relative to the bottom sheet and to permit sliding of the top sheet in a rearward direction relative to the bottom sheet.

2. The apparatus of claim 1, wherein the top sheet has at least one end connected to the bottom sheet.

3. The apparatus of claim 2, wherein the top sheet has a front edge connected to the bottom sheet, a rear edge connected to the bottom sheet, and side edges that are free with respect to the bottom sheet.

4. The apparatus of claim 1, wherein the cushioning member comprises a bladder that is adapted to be filled with fluid to provide cushioning.

5. The apparatus of claim 4, wherein the bladder comprises a first chamber and a second chamber each configured to be filled with fluid, wherein the first chamber and second chamber are sealed apart from each other.

6. The apparatus of claim 4, wherein the cushioning member further comprises a stiffening member positioned near a front end of the apparatus, the stiffening member providing added rigidity to the cushioning member and the bottom sheet.

7. The apparatus of claim 1, wherein the first engagement member comprises a brushed fiber material and the second engagement member comprises a stitched material with a directional stitching pattern extending in a width direction of the apparatus.

8. The apparatus of claim 7, wherein the stitched material has a herringbone stitching pattern extending in the width direction, and wherein the first engagement member and the second engagement member engage each other to resist sliding of the top sheet in the forward direction relative to the bottom sheet and to permit sliding of the top sheet in the rearward direction and in both lateral directions relative to the bottom sheet.

9. The apparatus of claim 7, wherein the first engagement member comprises two strips of the brushed fiber material extending across the engagement surface in the forward direction and spaced laterally from each other, and the second engagement member comprises a pad of the stitched material, the pad having a width that completely overlaps both of the two strips of the first engagement member.

10. The apparatus of claim 1, further comprising two straps attached to the top sheet and extending from opposed lateral edges of the top sheet, the straps configured to be grasped by a user to move the top sheet in the rearward direction relative to the bottom sheet.

11. The apparatus of claim 1, wherein the first engagement member comprises a brushed fiber material and the second engagement member comprises a material with a directionally oriented texture extending in a width direction of the apparatus.

12. The apparatus of claim 1, further comprising a second cushioning member connected to a rear end of the apparatus and adapted to extend upward from the rear end of the apparatus.

13. The apparatus of claim 1, further comprising a movement limiting mechanism that releasably connects the top sheet to the bottom sheet and temporarily limits movement of the top sheet with respect to the bottom sheet until the movement limiting mechanism is released.

14. An apparatus for use with a chair having a supporting surface, the apparatus comprising:

a first member adapted to be placed above the supporting surface of the chair, the first member having a bottom configured to confront the supporting surface and an engagement surface opposite the bottom;

a second member connected to the first member and having a bottom surface positioned in confronting relation to the engagement surface of the first member and a top surface opposite the bottom surface, the second member being connected to the first member such that at least a portion of the second member is slidable with respect to the first member; and a first engagement member positioned on one of the engagement surface of the first member and the bottom surface of the second member, the first engagement member comprising a brushed fiber material;

a second engagement member positioned on another of the engagement surface of the first member and the bottom surface of the second member and positioned in confronting relation to the first engagement surface, the second engagement member comprising a material with a directional pattern extending in a width direction of the apparatus;

wherein the first engagement member and the second engagement member engage each other to resist sliding of the second member in a forward direction relative to the first member and to permit sliding of the second member in a rearward direction.

15. The apparatus of claim 14, wherein the second member has a front edge connected to the first member, a rear edge connected to the first member, and side edges that are free with respect to the first member.

16. The apparatus of claim 14, wherein the first member further comprises a cushioning member forming at least a portion of the bottom thereof, the cushioning member comprising a bladder that is adapted to be filled with fluid to provide cushioning.

17. The apparatus of claim 16, wherein the bladder comprises a first chamber and a second chamber each configured to be filled with fluid, wherein the first chamber and second chamber are sealed apart from each other.

18. The apparatus of claim 16, wherein the cushioning member further comprises a stiffening member positioned near a front end of the apparatus, the stiffening member providing added rigidity to the cushioning member and the first member.

19. The apparatus of claim 14, wherein the material has a directional stitching pattern extending in the width direction to form the directional pattern.

20. The apparatus of claim 19, wherein the directional stitching pattern is a herringbone stitching pattern.

21. The apparatus of claim 14, wherein the first engagement member is connected to the engagement surface of the first member, and the second engagement member is connected to the bottom surface of the second member.

22. The apparatus of claim 21, wherein the first engagement member comprises two strips of the brushed fiber material extending across the engagement surface in the forward direction and spaced laterally from each other, and the second engagement member comprises a pad of the directional material, the pad having a width that completely overlaps both of the two strips of the first engagement member.

23. The apparatus of claim 14, further comprising two straps attached to the second member and extending from opposed lateral edges of the second member, the straps configured to be grasped by a user to move the second member in the rearward direction relative to the first member.

24. The apparatus of claim 14, wherein the first engagement member and the second engagement member engage each other to further permit sliding of the second member in both lateral directions relative to the first member.

25. An apparatus for use with a chair having a supporting surface, the apparatus comprising:

a cushioning member adapted to be placed above the supporting surface of the chair, the cushioning member comprising a bladder that is adapted to be filled with fluid to provide cushioning;

a bottom sheet connected to the cushioning member and having an engagement surface opposite the cushioning member;

a top sheet and having a bottom surface positioned in confronting relation to the engagement surface of the bottom sheet and a top surface opposite the bottom surface, the top sheet having a front edge connected to the bottom sheet, and the top sheet further having a slip resistant material positioned on the top surface;

a first engagement member positioned on the engagement surface of the bottom sheet, the first engagement member comprising a strip of a brushed fiber material extending across the engagement surface in a forward direction;

a second engagement member positioned on the bottom surface of the top sheet, the second engagement member comprising a pad of a stitched material having a herringbone stitching pattern extending in a width direction of the apparatus, the pad having a width that completely overlaps the first engagement member;

wherein the first engagement member and the second engagement member engage each other to resist sliding of the top sheet in a forward direction relative to the bottom sheet and to permit sliding of the top sheet in a rearward direction and in both lateral directions relative to the bottom sheet.

26. The apparatus of claim 25, wherein the top sheet further has a rear edge connected to the bottom sheet and side edges that are free with respect to the bottom sheet.

27. The apparatus of claim 25, wherein the bladder comprises a first chamber and a second chamber each configured to be filled with fluid, wherein the first chamber and second chamber are sealed apart from each other.

28. The apparatus of claim 25, wherein the cushioning member further comprises a stiffening member positioned near a front end of the apparatus, the stiffening member providing added rigidity to the cushioning member and the bottom sheet.

29. The apparatus of claim 25, wherein the cushioning member comprises barriers defining two separate chambers, the barriers further defining a plurality of cells in fluid communication with each other within each chamber.

30. The apparatus of claim 25, wherein the first engagement member comprises two strips of the brushed fiber material extending across the engagement surface in the forward direction and spaced laterally from each other, and wherein the width of the pad completely overlaps both of the two strips of the first engagement member.

31. The apparatus of claim 25, further comprising two straps attached to the top sheet and extending from opposed lateral edges of the top sheet, the straps configured to be grasped by a user to move the top sheet in the rearward direction relative to the bottom sheet.

32. A method comprising:

providing a chair having a supporting surface and a back positioned at a rear of the supporting surface;

placing an apparatus on the chair, the apparatus comprising:

a cushioning member adapted to be placed above the supporting surface of the chair;

a bottom sheet connected to the cushioning member and having an engagement surface opposite the cushioning member;

a top sheet having a bottom surface positioned in confronting relation to the engagement surface of the bottom sheet and a top surface opposite the bottom surface, the top sheet having a slip resistant material positioned on the top surface; and a selective gliding assembly positioned between the top sheet and the bottom sheet, the selective gliding assembly comprising a first engagement member positioned on the engagement surface of the bottom sheet and a second engagement member positioned on the bottom surface of the top sheet, wherein the first engagement member and the second engagement member engage each other to resist sliding of the top sheet in a forward direction relative to the bottom sheet and to permit sliding of the top sheet in a rearward direction relative to the bottom sheet;

positioning a person in a seated position on the chair, such that the person rests above the top surface of the top sheet and confronts at least a portion of the slip resistant material; and sliding the top sheet in the rearward direction toward the back of the chair, such that the person is pulled in the rearward direction by the sliding of the top sheet.

33. The method of claim 32, wherein the apparatus further comprises two straps attached to the top sheet and extending from opposed lateral edges of the top sheet, and sliding the top sheet is accomplished by grasping and pulling the straps in the rearward direction.

34. The method of claim 32, wherein the top sheet has a front edge connected to the bottom sheet, a rear edge connected to the bottom sheet, and side edges that are free with respect to the bottom sheet, wherein the person is positioned in the seated position when the top sheet is in a forward position and slack material between the top and bottom sheets is positioned at a front of the supporting surface, and wherein the top sheet is in a rearward position after sliding the top sheet in the rearward direction, such that at least some slack material between the top and bottom sheets is positioned at the rear of the supporting surface.

* * * * *